US010112387B2

(12) United States Patent
Moriya et al.

(10) Patent No.: US 10,112,387 B2
(45) Date of Patent: Oct. 30, 2018

(54) LIQUID DISCHARGING HEAD AND LIQUID DISCHARGING DEVICE

(71) Applicant: CANON KABUSHIKI KAISHA, Tokyo (JP)

(72) Inventors: Takatsugu Moriya, Tokyo (JP); Shuzo Iwanaga, Kawasaki (JP); Shintaro Kasai, Yokohama (JP); Yoshiyuki Nakagawa, Kawasaki (JP); Akiko Saito, Tokyo (JP); Tatsuya Yamada, Kawasaki (JP); Tomohiro Sato, Tokyo (JP); Ayako Iwasaki, Yokohama (JP); Tomoki Ishiwata, Kawasaki (JP); Koichi Ishida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/655,231

(22) Filed: Jul. 20, 2017

(65) Prior Publication Data

US 2018/0022087 A1 Jan. 25, 2018

(30) Foreign Application Priority Data

Jul. 22, 2016 (JP) ..... 2016-144669

(51) Int. Cl.

| | |
|---|---|
| ***B41J 2/045*** | (2006.01) |
| ***B41J 2/14*** | (2006.01) |
| *B41J 2/03* | (2006.01) |

(52) U.S. Cl.

CPC ..... *B41J 2/0458* (2013.01); *B41J 2/04595* (2013.01); *B41J 2/1404* (2013.01); *B41J 2/14048* (2013.01); *B41J 2/14056* (2013.01); *B41J 2/0456* (2013.01); *B41J 2002/033* (2013.01); *B41J 2002/14217* (2013.01)

(58) Field of Classification Search

CPC .... B41J 2/1433; B41J 2/0458; B41J 2/04595; B41J 2/1404; B41J 2/14048; B41J 2/14056

See application file for complete search history.

(56) References Cited

U.S. PATENT DOCUMENTS 7,887,159 B2 * 2/2011 Takei ..... B41J 2/1433 347/20
2013/0021411 A1 1/2013 Feinn

FOREIGN PATENT DOCUMENTS

JP 4818276 B2 11/2011

* cited by examiner

*Primary Examiner* — Juanita D Jackson
(74) *Attorney, Agent, or Firm* — Canon U.S.A., Inc. IP Division

(57) ABSTRACT

A liquid discharging head includes a discharge port that discharges a liquid, a pressure chamber that communicates with the discharge port, and an energy generating element that is disposed in the pressure chamber. In the liquid discharging head, the discharge port is provided with a plurality of projections that project towards a central portion of the discharge port from an inner peripheral edge of the discharge port, and an interval between the projections at a location where the projections are closest to each other is 5 μm or less.

22 Claims, 28 Drawing Sheets

LIQUID DISCHARGING HEAD AND LIQUID DISCHARGING DEVICE

BACKGROUND OF THE INVENTION

Field of the Invention

The present disclosure relates to a liquid discharging head and a liquid discharging device that discharge a liquid such as ink.

Description of the Related Art

As a method of discharging a liquid from a liquid discharging head such as an inkjet recording head, a thermal inkjet method which adds heat to a liquid, which causes a film to boil, and which makes use of a bubbling force thereof is available. The liquid discharging head of a thermal inkjet type includes a recording element board that has a discharge port which discharges a liquid, a pressure chamber which communicates with the discharge port, a channel which supplies a liquid to the pressure chamber, and a supply port which supplies a liquid to the channel. A heating resistance element (heater) is formed in the pressure chamber, and the liquid is discharged from the discharge port by using discharge energy (heat) generated by the heating resistance element.

When the liquid is discharged by such a liquid discharging head, the discharged liquid is formed with a columnar shape including a main droplet and a long and narrow tail that is connected to and extends behind the main droplet. The tail frequently becomes a very small liquid droplet, called a satellite droplet, as a result of being separated from the main droplet by the surface tension of the liquid that is being ejected. When the satellite droplet lands on a location on a recording medium that is displaced from a location of the main droplet, the recording quality is reduced.

As a method of reducing the generation of such a satellite droplet, the specifications of Japanese Patent No. 4818276 and U.S. Patent Application Publication No. 2013/0021411 propose a method of forming a discharge port with a shape other than a circular shape. This corresponds to forming a region having high resistance and a region having low resistance in the discharge port with respect to discharge liquid droplets, and allows the generation of satellite droplets to be reduced by increasing the difference between the resistances of the two regions.

In a structure such as those described in the specifications of Japanese Patent No. 4818276 and U.S. Patent Application Publication No. 2013/0021411, when the liquid in the discharge port is evaporated and the viscosity of the liquid is increased or a solid component of the liquid adheres to the vicinity of the discharge port, in particular, the resistance of the region having high resistance is further increased, as a result of which it may be difficult to discharge the liquid. When it becomes difficult to discharge the liquid, a reduction in the speed of the liquid droplets or discharge failure occurs during discharge. Therefore, the liquid droplets no longer precisely land on a desired location of a recording medium, as a result of which a reduction in image quality occurs. Consequently, the resistance of the region having high resistance can only be increased to a certain resistance. Thus, there is a limit as to how effectively the generation of satellite droplets is reduced.

SUMMARY OF THE INVENTION

The present disclosure provides a liquid discharging head and a liquid discharging device that are capable of reducing the generation of satellite droplets and that are capable of properly discharging liquid.

A liquid discharging head according to the present disclosure includes a discharge port that discharges a liquid, a pressure chamber that communicates with the discharge port, and an energy generating element that is disposed in the pressure chamber. The discharge port is provided with a plurality of projections that project towards a central portion of the discharge port from an inner peripheral edge of the discharge port. An interval between the projections at a location where the projections are closest to each other is 5 μm or less.

Further features of the present disclosure will become apparent from the following description of exemplary embodiments with reference to the attached drawings.

DESCRIPTION OF THE EMBODIMENTS

Embodiments of the present disclosure are described below with reference to the drawings. However, the descriptions below do not limit the scope of the present disclosure. Although, in the embodiments below, a thermal inkjet type that discharges liquid by generating air bubbles by using heating resistance elements is used, the present disclosure is also applicable to a liquid discharging head that uses a piezo method or to liquid discharging heads that use various other liquid discharging methods.

Liquid Discharging Head According to a First Embodiment

Figure 1A:
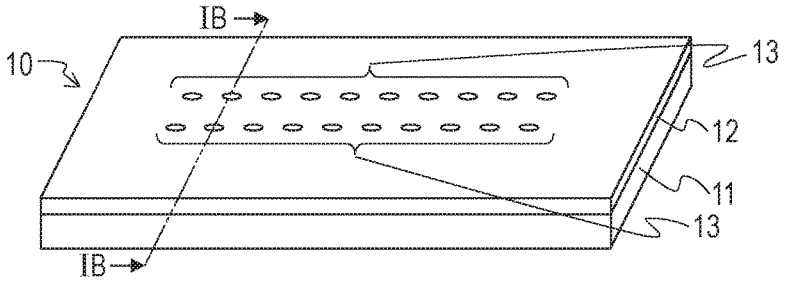
FIGS. 1A to 1D illustrate a recording element board and discharge ports of a liquid discharging head according to a first embodiment of the present disclosure.
Figure 1B:
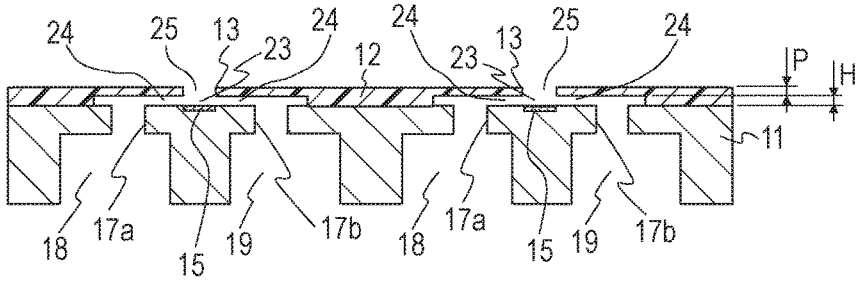
Figure 1C:
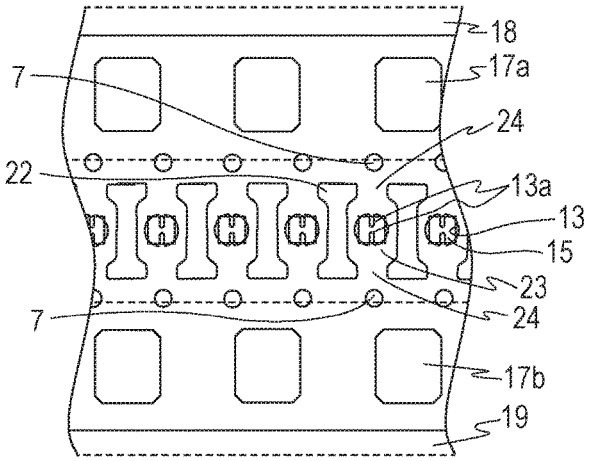
Figure 1D:
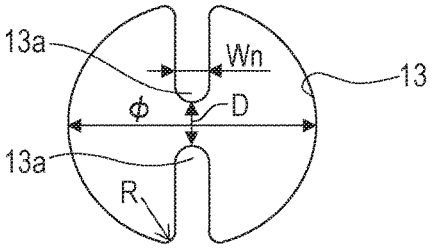

FIGS. 1A to 1D illustrate a liquid discharging head according to a first embodiment of the present disclosure. FIG. 1A is an external perspective view of a recording element board 10, which is a main portion of the liquid discharging head according to the first embodiment. FIG. 1B is a sectional view taken along line IB-IB in FIG. 1A. FIG. 1C is a partial perspective plan view of the recording element board 10 when seen from a side of discharge ports 13. FIG. 1D is an enlarged plan view of one discharge port 13.

The recording element board 10 of the liquid discharging head includes a substrate 11 and a discharge port forming member 12 that is placed upon the substrate 11. Discharge ports 13, liquid discharge paths (nozzles) 25, pressure chambers 23, channels 24, and energy generating elements (recording elements) 15 are formed in the recording element board 10 of the liquid discharging head. The liquid discharge paths 25 are through holes that extend through the discharge port forming member 12 at locations opposing the pressure chambers 23 and the recording elements 15. Outer end portions of the liquid discharge paths 25, that is, end portions of the liquid discharge paths 25 opposite to a side where the substrate 11 is placed are open. The open ends correspond to the discharge ports 13 that discharge liquid (ink). That is, the discharge ports 13 are each one of the open ends of the corresponding liquid discharge path 25, and are each a port that is positioned in a surface of the corresponding discharge port forming member 12 opposing a recording medium.

The pressure chambers 23 are each a space that communicates with the discharge port 13 and the liquid discharge path 25, and are each formed between the substrate 11 and the discharge port forming member 12. An example of each recording element 15 is a heating resistance element. Each recording element 15 is provided facing the corresponding discharge port 13 at a location on the substrate 11 and in the corresponding pressure chamber 23. That is, as seen from the discharge ports 13, each recording element 15 is provided in the corresponding pressure chamber 23 so as to overlap the corresponding discharge port 13. Each channel 24 is a space that communicates with the corresponding pressure chamber 23, and is formed between the substrate 11 and the discharge port forming member 12. Two channels 24 communicate with one pressure chamber 23. Supply paths 17*a* and recovery paths 17*b* that communicate with the corresponding pressure chambers 23 via the corresponding channels 24 are provided in the substrate 11. Nozzle filters 7 are provided at inlets and outlets of the channels 24 on both sides of the pressure chambers 23. The pressure chambers 23 and the channels 24 are separated from adjacent pressure chambers 23 and channels 24 by partitions 22. In this structure, liquid that has flown in from each supply path 17*a* is supplied to the corresponding pressure chamber 23 via the corresponding channel 24. When discharge energy (heat) is applied to the liquid in each pressure chamber 23 from the corresponding recording element 15, part of the liquid is discharged to the outside from the corresponding discharge port 13. The remaining part of the liquid (part that is not discharged from the discharge ports 13), or liquid in each pressure chamber 23 when discharge energy is not applied from the corresponding recording element 15 can circulate by passing through the corresponding pressure chamber 23 and the corresponding liquid discharge path 25 and flowing through the corresponding recovery path 17*b* via the corresponding channel 24.

Each discharge port 13 (see FIG. 1D) according to the embodiment is not perfectly circular, but rather has projections 13*a* that project towards an inner side (central portion) from an inner peripheral edge of the discharge port 13. The technical significance of each projection 13*a* is described below.

Figure 2A:
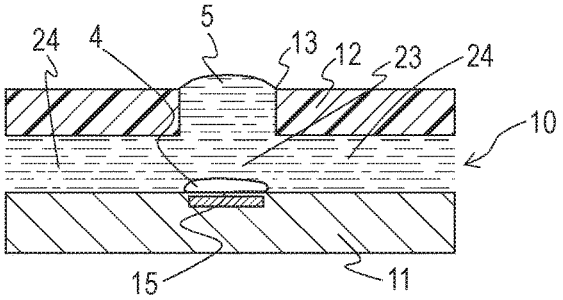
FIGS. 2A to 2E are each a sectional view of a liquid discharging step of the liquid discharging head according to the first embodiment.
Figure 2B:
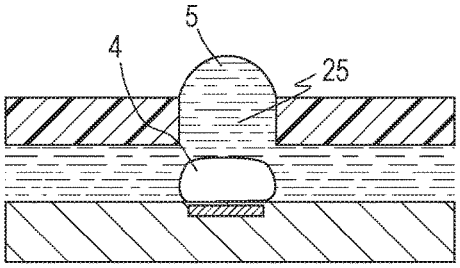
Figure 2C:
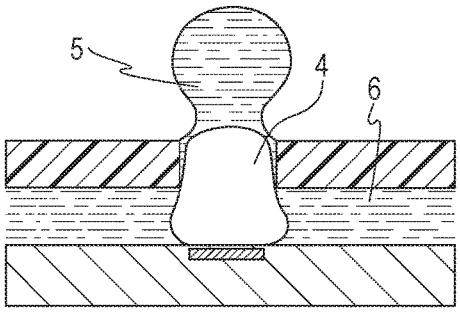
Figure 2D:
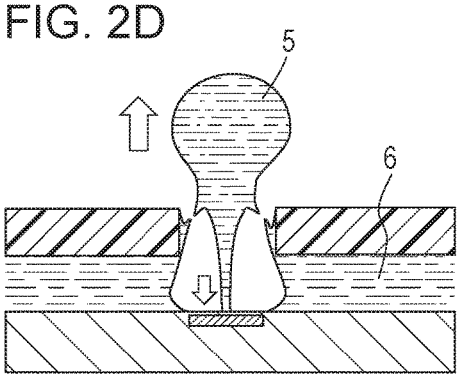
Figure 2E:
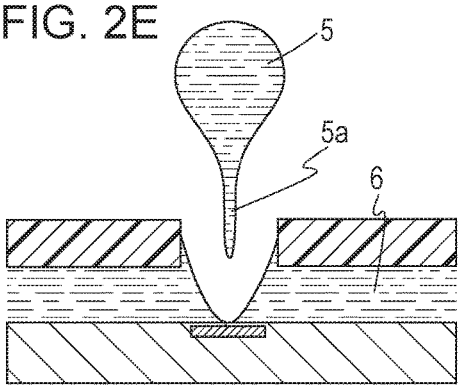

The background for providing the projections 13*a* according to the present disclosure is described with reference to FIGS. 2A to 2E. FIGS. 2A to 2E are figures for describing a state in which liquid is discharged by using the recording element board 10 according to the present disclosure. FIG. 2A illustrates a state in which a recording element 15 is driven when the channel 24 and the pressure chamber 23 are filled with liquid in the recording element board 10. When the recording element 15 is driven, thermal energy is generated and the liquid in the pressure chamber 23 is heated thereby. When the liquid is heated, the liquid bubbles, and a bubble 4 is generated above the recording element 15. When the volume of the bubble 4 is increased as a result of continuing heating and bubbling of the liquid, as shown in FIG. 2B, the liquid in the pressure chamber 23 passes through the liquid discharge path 25 and is pushed out from the discharge port 13. When the volume of the bubble 4 is further increased, as shown in FIG. 2C, the bubble 4 moves into the liquid discharge path 25, and is put in a state in which the bubble 4 separates a discharge liquid droplet 5 and a liquid 6 in the channel 24. Thereafter, the bubble 4 grows to one having maximum volume, after which the bubble 4 starts to become smaller. When the bubble 4 shrinks, as shown in FIG. 2D, portions of a trailing end portion of the discharge liquid droplet 5 in a discharge direction come closer together in a central portion of the recording element 15. At this time, when the air bubble 4 shrinks, a difference in speed in a direction opposite to an ink discharge direction occurs between a leading end portion and the trailing end portion of the discharge liquid droplet 5 (as indicated by arrows in FIG. 2D). This causes a long and narrow tail 5*a* to be formed at the trailing end portion of the discharge liquid droplet 5 in the discharge direction. Thereafter, as shown in FIG. 2E, the discharge liquid droplet 5 is separated from the liquid 6 in the pressure chamber 23 and the liquid discharge path 25, and is discharged to the outside of the discharge port 13. The slower the timing of the separation, the longer the tail 5*a* becomes, and the greater the tendency with which the tail 5*a* is further separated into a main droplet and a satellite droplet due to the speed difference and surface tension of the liquid. The satellite droplet may reduce the recording quality.

Therefore, it is desirable to shorten the tail 5*a* by quickening the timing of the separation, and reduce a reduction in the recording quality caused by the satellite droplet. Accordingly, in the present disclosure, as shown in FIG. 1D, a plurality of projections 13*a* (for example, two projections 13*a*) that project towards the inner side from the inner peripheral edge of the discharge port 13 are formed, and an interval (shortest interval) D between the projections at a location where they are closest to each other is 5 μm or less. In this way, by forming the projections 13*a* at the discharge port 13 and setting the shortest interval D small, when the bubble 4 shrinks, the trailing end portion of the discharge liquid droplet 5 in the discharge direction that has moved towards the central portion of the recording element 15 is narrowed down, and the tail 5*a* becomes thin. As a result, the timing of the separation is quickened, and the tail 5*a* is shortened, as a result of which the possibility of the satellite droplet separating from the main droplet is reduced. Even if the satellite droplet is separated from the main droplet, since the tail 5*a* is short, the satellite droplet is small and the number of satellite droplets is reduced.

Figure 3:
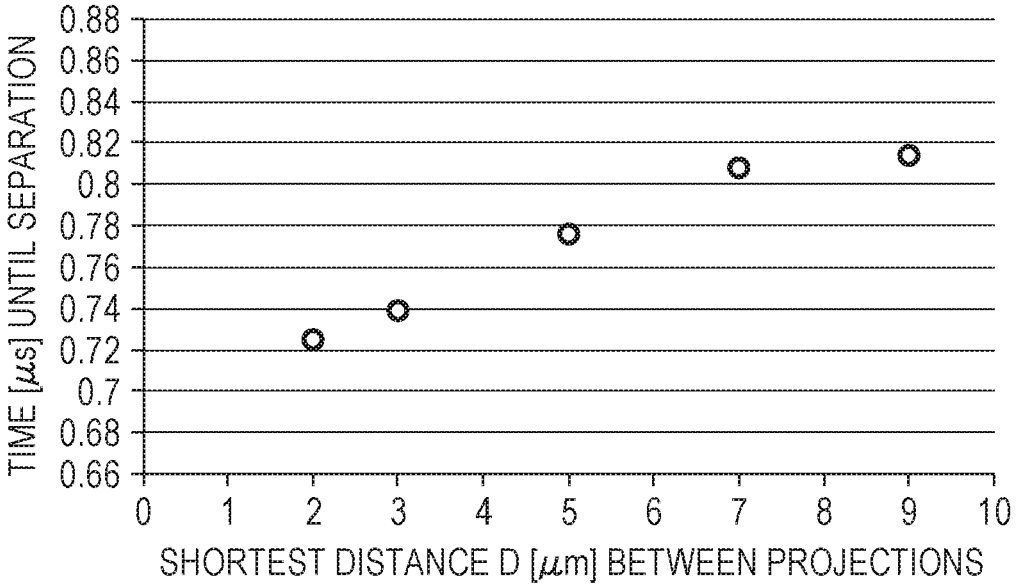
FIG. 3 is a graph showing the relationship between a shortest interval between projections of a discharge port and the time until separation.

FIG. 3 shows the results obtained by determining the relationship between the shortest interval D at each discharge port 13 having projections 13*a* and the time from when driving of the corresponding recording element 15 is started to the separation. The conditions for determining the relationship are as follows. The viscosity of liquid is 3 cp, and the surface tension of the liquid is 60 mN/m. A diameter ϕ of the discharge port 13 shown in FIG. 1D is 20 μm, a width Wn of each projection 13*a* is 2 μm, and a curvature radius R of a base of each projection 13*a* (connection portion with the inner peripheral edge of the discharge port) is 1 μm. A height H of each pressure chamber 23 shown in FIG. 1B is 5 μm, and a height P of each liquid discharge path 25 shown in FIG. 1B is 4.5 μm. The volume of a discharge liquid droplet 5 is approximately 2 pl, and the discharge speed of a main droplet is approximately 12 m/s. Separation timings when a liquid was discharged by driving the recording elements 15 under the above-described conditions by using a plurality of liquid discharging heads having discharge ports 13 having different shortest intervals D between the projections 13*a* were calculated. As a result, it was found that the smaller the shortest interval D between the projections 13*a*, the shorter the time until the separation as shown in FIG. 3. In particular, when the shortest interval D between the projections 13*a* is 5 μm or less, the time until the separation is particularly short. This makes it possible to reduce a reduction in the recording quality caused by satellite droplets.

FIG. 3 shows the results of the calculations performed on the basis of the above-described conditions, and shows essentially the same tendency even under different conditions. For example, even when the viscosity of the liquid is 20 cP or less, and the surface tension is 20 to 70 mN/m, the time until the separation is influenced by the shortest interval D between the projections 13*a*; and when the shortest interval D between the protrusions 13*a* is 5 μm or less, the time until the separation is particularly short. In this way, when each discharge port 13 is provided with a plurality of projections 13*a* that project towards the center of the corresponding discharge port 13, the shortest interval D between the projections 13*a* is 5 μm or less, and the liquid is allowed to circulate via the interiors of the pressure chambers 23 and the liquid discharge paths 25, it is possible to reduce the generation of satellite droplets. As a result, it is possible to improve the recording quality.

In other words, the structure of each discharge port 13 is such that part of each discharge port 13 is narrow, and the shortest diameter (shortest interval) D of each narrowed portion is 5 μm or less. In the example shown in FIG. 1D, the shortest diameter D extends through the center of the discharge port. As in the examples shown in FIGS. 5B and 5C described below, the shortest diameter D need not extend through the center of the discharge port 13.

When the viscosity of the liquid used is low (such as 15 cP or less), proper discharge tends to be performed. However, when a liquid having high viscosity at normal temperature is used, it is possible to provide the liquid discharging head with a temperature adjusting unit (not shown), reduce the viscosity of the liquid by raising the temperature of the liquid in each pressure chamber 23, and make it easier to properly discharge the liquid. When the diameter ϕ of each discharge port 13 is 30 μm or less, reducing the shortest interval D between the projections 13*a* is particularly effective in reducing the generation of satellite droplets.

The smaller the shortest interval D between the projections 13*a*, the larger the effect of reducing the generation of satellite droplets. However, when the shortest interval D is too small, a main droplet of a discharge liquid droplet 5 may be divided into a plurality of droplets, and may not land on a desired location on a recording medium. Therefore, it is desirable that the shortest interval D be set such that only one liquid column of the discharge droplet 5 that is discharged from one discharge port 13 be formed without being divided into a plurality of droplets.

When the shortest interval D between the projections 13*a* is small, the resistance against the discharge liquid droplet 5 becomes large. Therefore, problems, such as a large reduction in the discharge speed and improper discharge, may occur. In particular, the aforementioned problems may occur when the resistance is increased due to an increase in the viscosity of the liquid as a result of evaporation of the liquid from the discharge ports 13 or adhesion of the liquid to the vicinity of the discharge ports 13. Accordingly, in order to make it possible to cause the shortest interval D between the projections 13*a* to be small without the occurrence of such problems, it is desirable to form circulatory flow of the liquid that passes through the interior of each pressure chamber 23 and each liquid discharge path 25 to reduce a reduction in the viscosity of the liquid with time. Therefore, even if a liquid having a viscosity that is high to a certain degree is used, a further reduction in the viscosity is reduced. Therefore, it is possible to easily perform good liquid discharge by reducing the shortest interval D between the projections 13*a* to 5 μm or less. Specific structural examples for circulating a liquid are described below.

In order to minimize the resistance against the discharge liquid droplet 5, it is desirable that a length P of each liquid discharge path 25 in the discharge direction be small, in particular, 6 μm or less. In order to efficiently apply discharge energy to the discharge liquid droplet 5 from each recording element 15, it is desirable that an interval (P+H)

between each recording element 15 and its corresponding discharge port 13 be small, in particular, 12 μm or less. Such a dimensional relationship allows the discharge speed of each discharge liquid droplet 5 during separation to be increased, and a structure that is more robust with respect to a disturbance, such as the flow of air caused by a recording medium, to be formed.

Figure 4A:
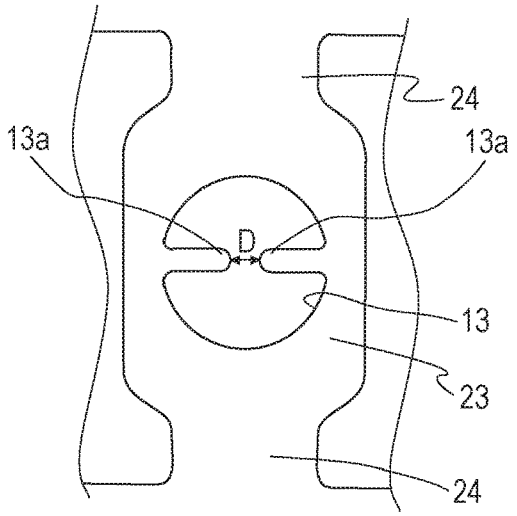
FIGS. 4A to 4C are each a plan view of a main portion of a recording element board according to a modification of the first embodiment.
Figure 4B:
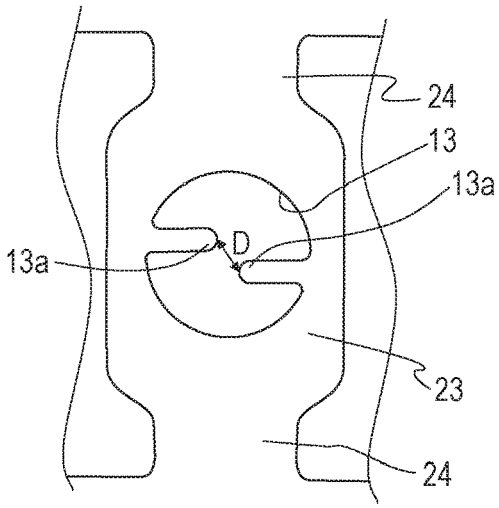
Figure 4C:
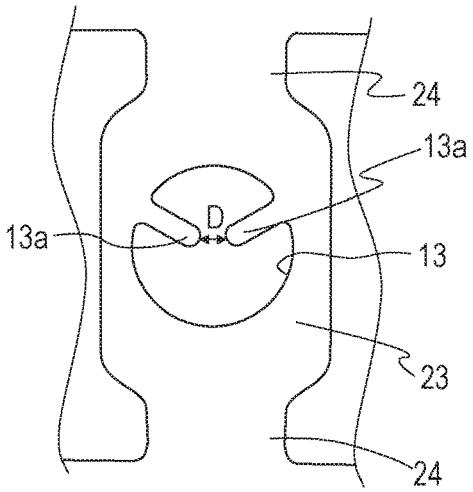

In order to reduce bending of discharge liquid droplets in a direction that is not intended, as shown in FIGS. 1C and 1D, it is desirable that the projections 13*a* at the discharge ports 13 each have shapes and are positioned such that the leading end portions of two projections 13*a* that are parallel to the flow of a liquid that passes through the channel 24 and the pressure chamber 23 oppose each other. However, various modifications such as those shown in FIGS. 4A to 4C are also possible. That is, as shown in FIG. 4A, the projections 13*a* may have shapes and may be positioned such that the leading end portions of two projections 13*a* extending perpendicularly to the flow of a liquid that passes through the channel 24 and the pressure chamber 23 oppose each other (the center lines of the projections 13*a* are on the same line). Alternatively, as shown in FIG. 4B, the projections 13*a* may have shapes and may be positioned such that the leading end portions of two projections 13*a* extending perpendicularly to the flow of a liquid that passes through the channel 24 and the pressure chamber 23 do not oppose each other, but are rather slightly displaced from each other (the center lines of the projections 13*a* are not on the same line). Still alternatively, as shown in FIG. 4C, two projections 13*a* extending obliquely with respect to the flow of a liquid passing through the channel 24 and the pressure chamber 23 may be formed. In the structures shown in FIGS. 4A to 4C, it is desirable that the shortest interval between the illustrated projections 13*a* (the interval between the projections 13*a* at the location where the projections 13*a* are closest to each other) be 5 μm or less.

Figure 5A:
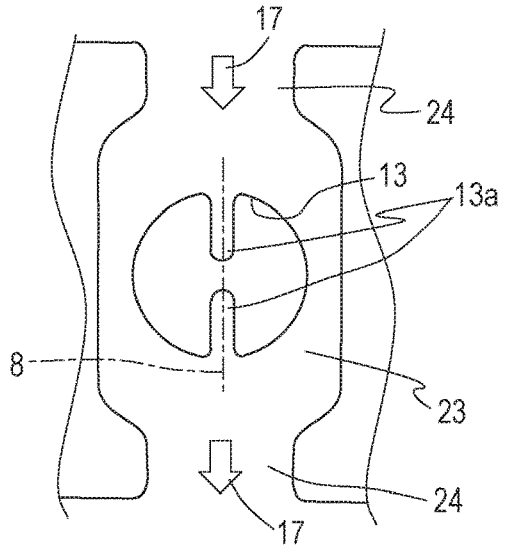
FIGS. 5A to 5C are each a plan view of a main portion of a recording element board according to a modification of the first embodiment.

Although the shapes and positions of the projections 13*a* are not limited to certain shapes and positions in this way, in order to stabilize the discharge direction of the ink droplets, it is desirable that the discharge ports 13 having the projections 13*a* have linearly symmetrical shapes. That is, referring to FIGS. 5A to 5C, it is desirable that the discharge ports 13 have linearly symmetrical shapes with the direction of a flow 17 of a liquid that passes through the channels 24 and the pressure chambers 23 corresponding to a symmetry axis 8. This is because when the flow 17 of the liquid passes through as wide a region as possible in each liquid discharge path 25 and circulates, the effect of reducing an increase in the viscosity of the liquid is increased, and forming the shape of each projection 13*a* with a linearly symmetrical shape around the direction of the flow 17 of the liquid makes it easier to achieve this effect.

Figure 5B:
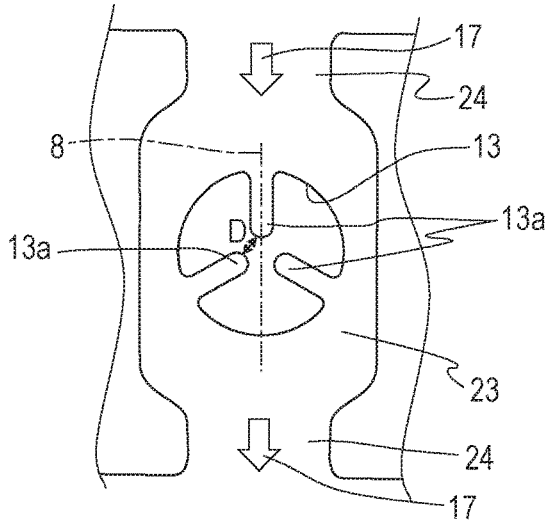
Figure 5C:
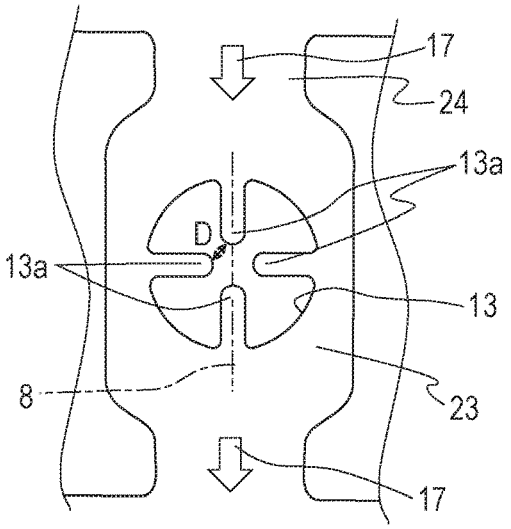

The present disclosure is not limited to the structure in which one discharge port 13*a* has two projections 13*a* as shown in FIGS. 4A to 4C and FIG. 5A. As shown in FIGS. 5B and 5C, one discharge port 13 may have three or more projections 13*a*. Even in these cases, as mentioned above, it is desirable that each discharge port 13 having projections 13*a* have linearly symmetrical shapes with the direction of the flow 17 of the liquid that passes through the channel 24 and the pressure chamber 23 corresponding to the symmetry axis 8.

Liquid Discharging Head According to a Second Embodiment

Figure 6A:
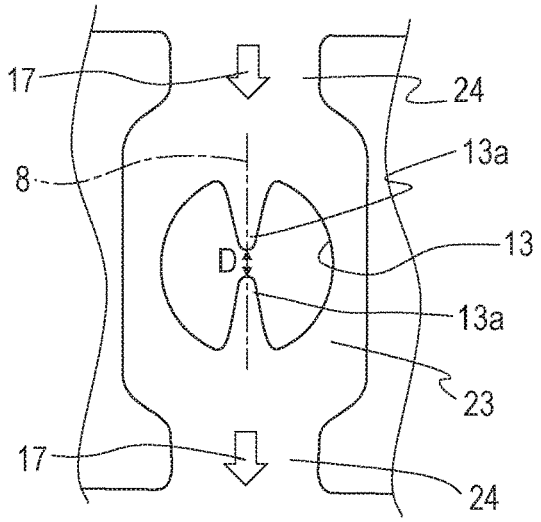
FIGS. 6A to 6C are a plan view of a recording element board, a discharge port, and projections of a liquid discharging head according to a second embodiment.
Figure 6B:
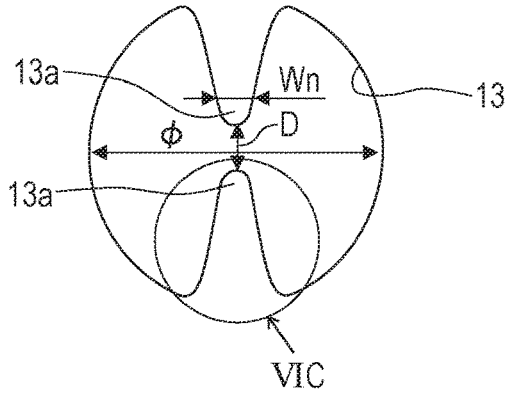
Figure 6C:
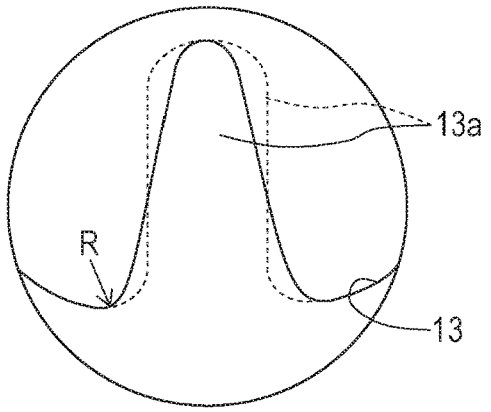

FIGS. 6A to 6C each illustrate a main portion of a liquid discharging head according to a second embodiment of the present disclosure. FIG. 6A is a plan view of the vicinity of a discharge port 13 according to the second embodiment. FIG. 6B is an enlarged view of the discharge port 13. FIG. 6C is an enlarged view of a portion VIC in FIG. 6B. In FIG. 6C, for comparison, the shape of a projection 13*a* according to the first embodiment is indicated by a broken line.

In the second embodiment shown in FIGS. 6A to 6C, the projections 13*a* of each discharge port 13 each have a tapering shape in which a projection width Wn of a base is large and a projection width Wn of a leading end side is small. When each projection 13*a* has such a tapering shape, the flow of a liquid that passes through the corresponding channel 24 and the corresponding pressure chamber 23 tends to move into a central portion of the corresponding discharge port 13, as a result of which an increase in the viscosity of the liquid at the central portion of the corresponding discharge port 13 having a relatively high resistance is reduced, thereby making it easier to discharge the liquid. For example, by virtue of a structure in which each projection 13*a* is such that the projection width Wn of the base is 4 μm and the projection width Wn of the leading end is 2 μm, and in which the other dimensions are the same as those according to the first embodiment, it is possible to properly realize the aforementioned effects.

Relationship Between Dimensions of Channels of Liquid Discharging Head

In order to increase the efficiency of a circulatory flow of a liquid, it is desirable that the dimensions of each portion of each channel of the liquid discharging head satisfy the following relationship:

$$H^{-0.34} \times P^{-0.66} \times W > 1.7$$

H is the height of a pressure chamber 23 (height on an upstream side of a corresponding discharge port 13 in the direction of flow of a liquid when the height of the pressure chamber 23 is not constant), P is the length of a liquid discharge path 25 in the liquid discharge direction, and W is the diameter of a discharge port 13 in the direction of flow of the liquid in the corresponding channel 24. When a structure satisfies this relationship, a sufficient circulatory flow moves into the liquid discharge path 25, and, then, the circulatory flow that has moved into the liquid discharge path 25 returns to the channel. Therefore, it is possible to reduce an increase in the viscosity up to a liquid in the vicinity of the discharge port 13, thereby making it easier to realize a good liquid discharge. This is particularly effective when a liquid originally having high viscosity is used.

Figure 7A:
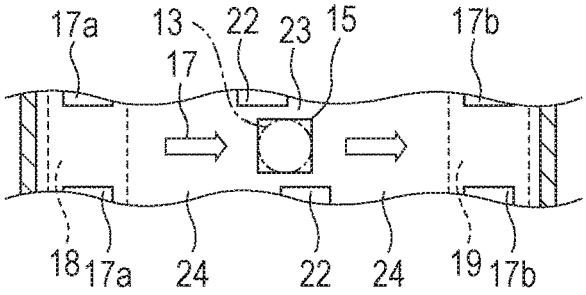
FIGS. 7A to 7C each illustrate a channel structure near a discharge port of the liquid discharging head according to the first embodiment.
Figure 7B:
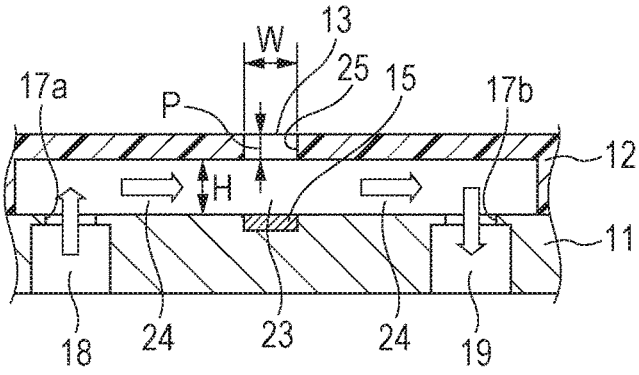
Figure 7C:
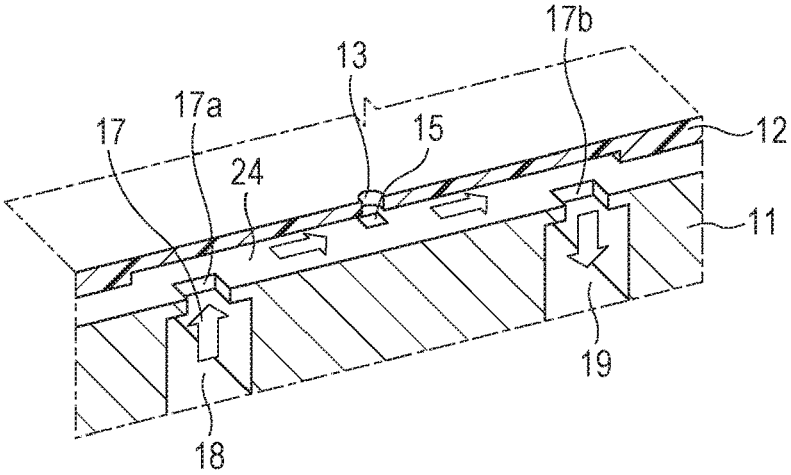
Figure 8A:
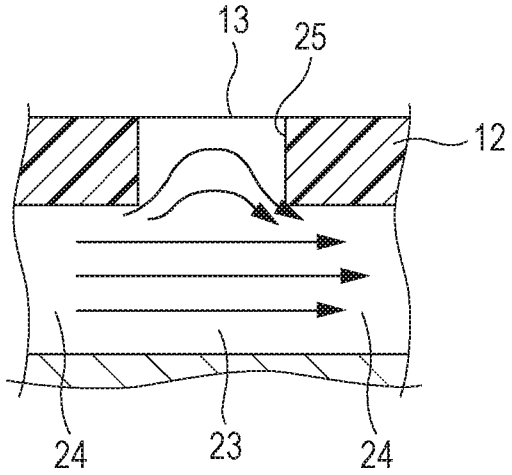
FIGS. 8A and 8B schematically illustrate the flow of a liquid that flows in the channel structure shown in FIGS. 7A to 7C.

In the example shown in FIGS. 7A to 7C, H is 3 μm to 30 μm, P is 3 μm to 30 μm, and W is 6 μm to 30 μm. An example of a liquid that is used is ink adjusted so as to have a nonvolatile solvent concentration of 30%, a color material density of 3%, and a viscosity of 0.002 to 0.003 Pa·s. FIG. 8A illustrates, as a more detailed example, the state of a flow 17 (see FIGS. 7A to 7C) of a liquid in a discharge port 13, a liquid discharge path 25, and a channel 24 when the flow 17 of the liquid that flows through the corresponding pressure chamber 23 and the corresponding channel 24 of the liquid discharging head becomes steady. In FIGS. 7A to 7C and FIG. 8A, the lengths and the sizes of the arrows do not indicate the speed of flow of the liquid. FIG. 8A illustrates the liquid discharging head in which the height H of the pressure chamber 23 and the channel 24 is 14 μm, the length P of the liquid discharge path 25 in the liquid discharge direction is 10 μm, and the length (diameter) W of the discharge port in a flow direction is 17 μm. In addition, FIG. 8A illustrates the flow when the liquid flows into the channel 24 from a corresponding liquid supply path 18 with a flow rate of $1.26 \times 10^{-4}$ ml/min.

Figure 8B:
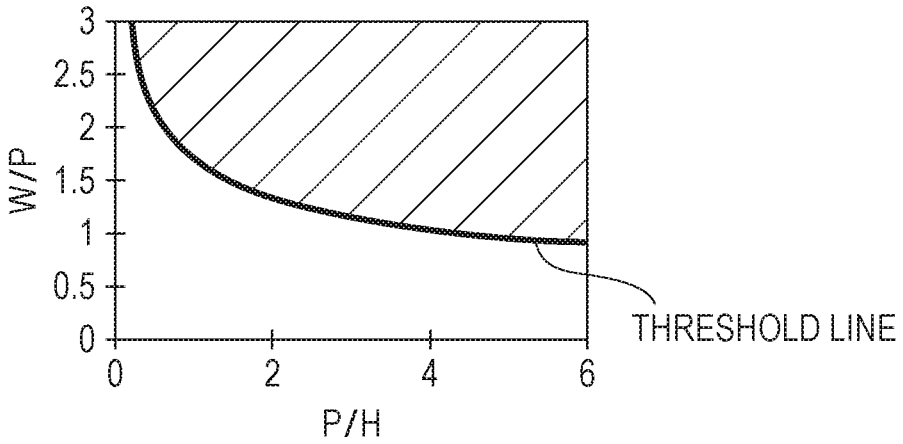

In the examples shown in FIGS. 7A to 7C and 8A, the aforementioned dimensions H, P, and W satisfy the relationship $H^{-0.34} \times P^{-0.66} \times W > 1.7$. Therefore, as shown in FIG. 8A, after the flow 17 of the liquid that flows in the channel 24 moves into the liquid discharge path 25 and reaches a position corresponding to at least half of the length P of the liquid discharge path 25 in the liquid discharge direction, a flow that returns to the channel 24 is generated again. The liquid that has returned to the channel 24 flows into a common recovery channel (described below) via a recovery path 19. That is, after at least part of the flow 17 of the liquid reaches a position corresponding to ½ or more of the liquid discharge path 25 in a direction from the pressure chamber 23 to the discharge port 13, the flow 17 returns to the channel 24. In this way, by causing the liquid to continuously flow through a large region in the liquid discharge path 25, it is possible to reduce thickening of the liquid. By generating such a flow of liquid in the liquid discharging head, it is possible to allow not only the liquid in the channel 24, but also the liquid in the liquid discharge path 25 to flow to the channel 24, as a result of which it is possible to reduce the thickening of the liquid and an increase in the color material density of the liquid. FIG. 8B is a graph showing the relationship between P/H and W/P. At a region in which the dimensions H, P, and W are larger than those on a threshold line shown in FIG. 8B, a liquid, such as that described above, in a liquid discharge path 25 can flow into the corresponding channel 24. At a region in which the dimensions H, P, and W are smaller than those on the threshold line shown in FIG. 8B, circulatory flow that has moved into the liquid discharge path 25 becomes an eddy in the liquid discharge path 25, as a result of which the amount of circulatory flow returning to the channel is reduced. Therefore, the effect of reducing an increase in the thickening of the liquid near the corresponding discharge port 13 is reduced. Here, the threshold line in FIG. 8B is expressed by the following expression:

$$(W/P)=1.7\times(P/H)^{-0.34}$$

When the dimensions H, P, and W are larger than those on the threshold line, $$(W/P)>1.7\times(P/H)^{-0.34}$$

When this formula is modified, the expression becomes the relational expression, $H^{-0.34} \times P^{-0.66} \times W > 1.7$.

Liquid Discharging Device

A liquid discharging device according to the present disclosure including the liquid discharging head having the above-described structure is described below. The liquid discharging device that serves as an exemplification below is, as described above, an inkjet recording device of a type in which a liquid, such as ink, is caused to circulate between a container (tank) and the liquid discharging head. However, the present disclosure may be applied to a liquid discharging device of a different type in which, for example, tanks are provided, one on an upstream side of the liquid discharging head and one on a downstream of the liquid discharging head and in which a liquid is caused to flow from one of the tanks to the other tank to cause the liquid to flow at all times via the pressure chambers.

The liquid discharging head of the liquid discharging device that serves as an exemplification below is a so-called line head having a length corresponding to the width of a recording medium. However, the present disclosure may be applied to a so-called serial liquid discharging head that performs recording while scanning a recording medium. An example of a serial liquid discharging head is one having a structure including a black ink recording element board and a color ink recording element board. However, a liquid discharging head which includes a plurality of recording element boards for corresponding colors disposed so as to overlap discharge port rows in a discharge port direction, which has a length that is less than the width of a recording medium, and which scans the recording medium may be used.

Figure 9:
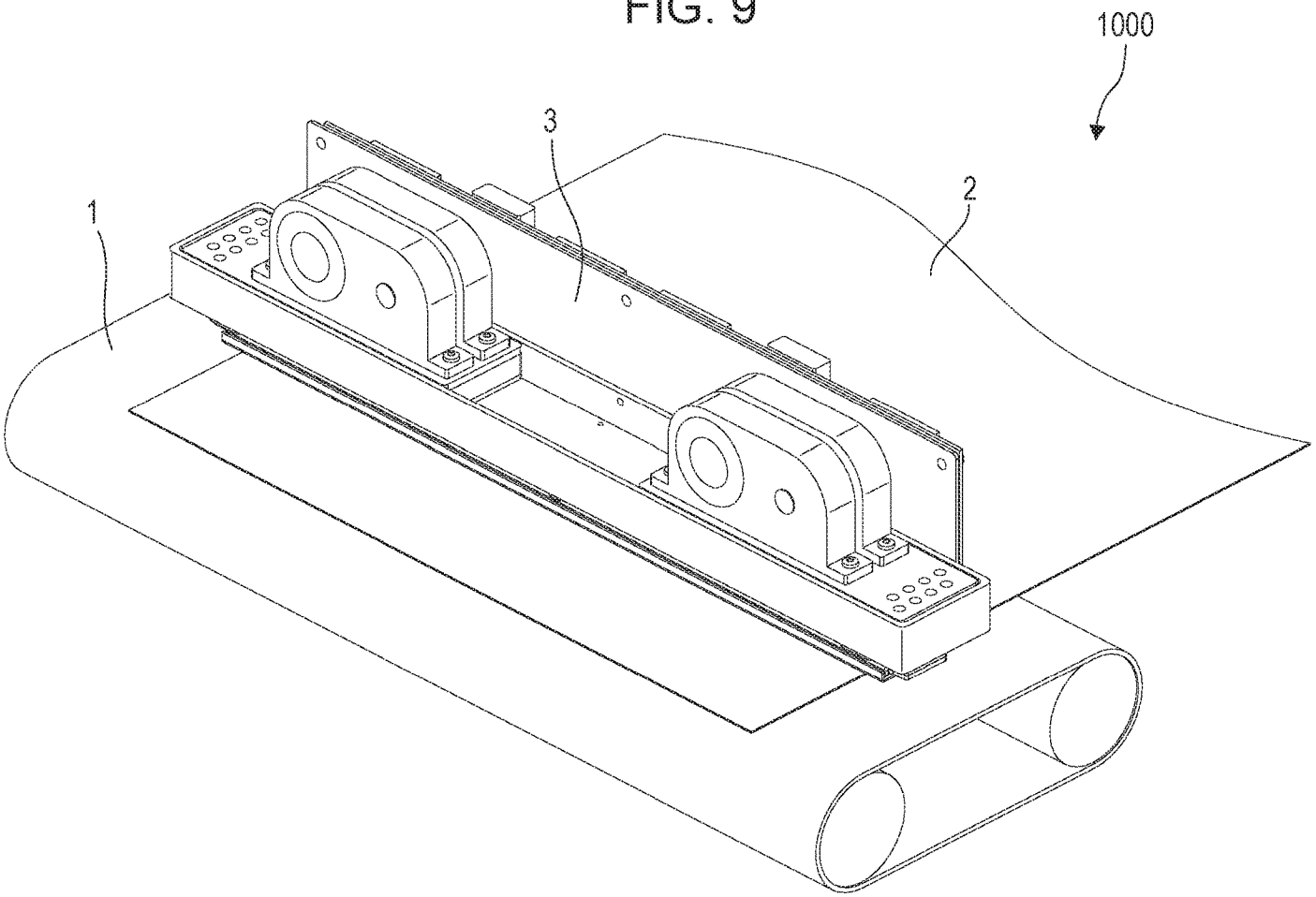
FIG. 9 is a perspective view of a main portion of a liquid discharging device according to a first exemplary embodiment of the present disclosure.

A structure of an inkjet recording device 1000 (hereunder may also be called a "recording device") that is a first exemplary embodiment of the liquid discharging device according to the present disclosure and that performs recording by discharging liquid ink is schematically shown in FIG. 9. The recording device 1000 is a line recording device including a conveying unit 1 that conveys a recording medium 2 and a line liquid discharging head 3 that is long and that is disposed such that the longitudinal direction is substantially orthogonal to the conveying direction of the recording medium 2. The line recording device may perform continuous recording in one pass while continuously or intermittently conveying a plurality recording media (cut sheets) or may perform recording while conveying a continuous roll sheet as the recording medium 2. The liquid discharging head 3 is capable of performing full-color printing by using liquid inks of four colors CMYK (cyan, magenta, yellow, and black). As described below, a liquid supplying unit that has a supply path that supplies a liquid to the liquid discharging head, a main tank that stores a liquid, and a buffer tank (see FIGS. 19A and 19B) are connected to the liquid discharging head 3 so as to allow circulation of the liquid. An electricity controller that transmits electric power and a discharge control signal to the liquid discharging head 3 is electrically connected to the liquid discharging head 3. Liquid paths and electrical signal paths in the discharging head 3 are described below.

First Circulation Path

Figure 10A:
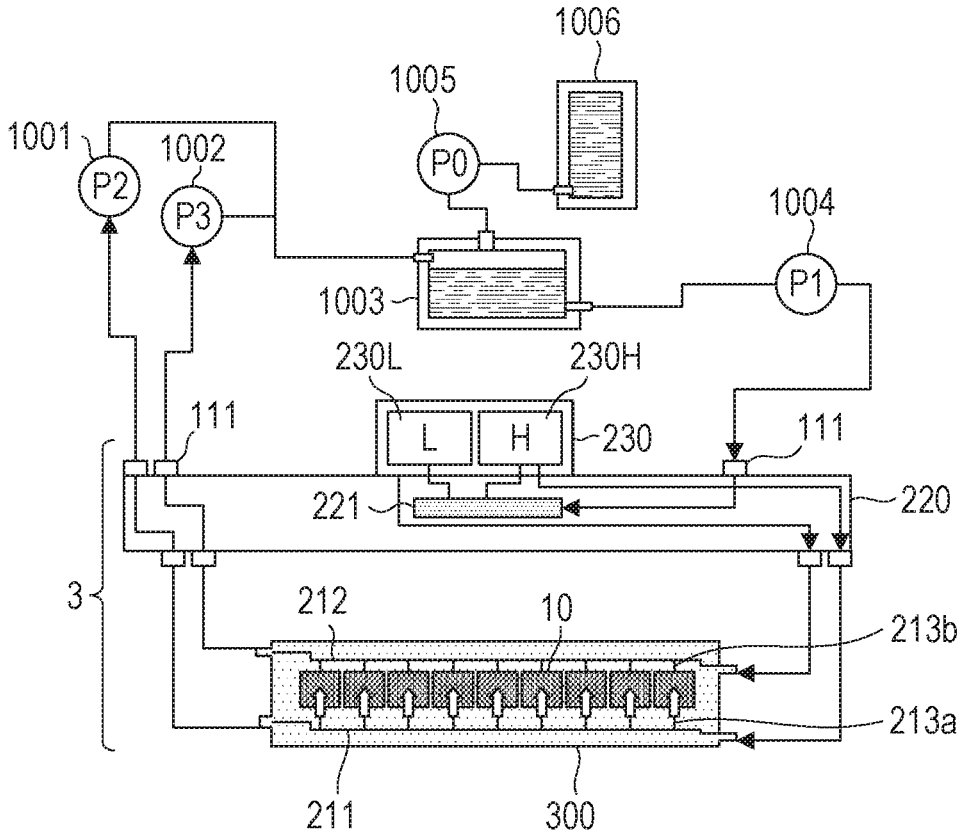
FIGS. 10A and 10B are each a schematic view of a liquid circulation path of the liquid discharging device shown in FIG. 9.
Figure 10B:
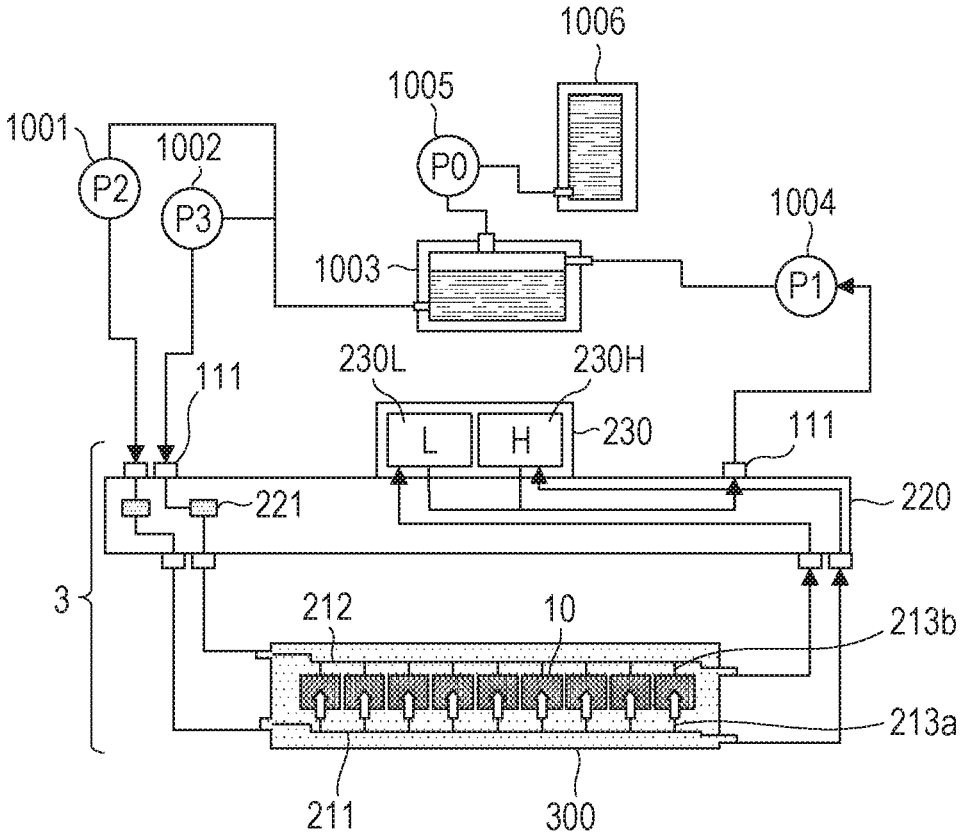

FIG. 10A is a schematic view of a first circulation path, which is a type of circulation path used in the recording device according to the exemplary embodiment. FIG. 10A illustrates a state in which the liquid discharging head 3 is connected to a first circulation pump (high pressure side) 1001, a first circulation pump (low pressure side) 1002, and a buffer tank 1003, etc., so as to allow circulation of a liquid. In FIGS. 10A and 10B, although for simplifying the explanation, only one circulation path in which ink of one color among the CMYK inks circulates is shown, circulation paths for four colors are actually provided in the liquid discharging head 3 and a recording device body. The buffer tank 1003, which is a sub-tank that is connected to the main tank 1006, has an air communication port (not shown) that allows an inner portion and an outer portion of the tank to communicate with each other, and discharges bubbles in the ink to the outside. The buffer tank 1003 is also connected to a replenishing pump 1005. When the ink is consumed by the liquid discharging head 3, the replenishing pump 1005 transfers ink of an amount corresponding to the amount of consumed ink to the buffer tank 1003 from the main tank 1006. The ink is consumed by the liquid discharging head 3 by, for example, discharging the ink from the discharge ports of the liquid discharging head 3 for, for example, a recording operation or a suction recovery operation.

The two first circulation pumps 1001 and 1002 suck ink from liquid connecting units 111 of the liquid discharging head 3 and cause the ink to flow to the buffer tank 1003. As the first circulation pump, it is desirable to use a displacement pump having a quantitative liquid feeding capability, more specifically, a tube pump, a gear pump, a diaphragm pump, or a syringe pump. However, other types of pumps such as those in which a general constant flow valve or a relief valve is provided at a pump outlet to ensure a constant flow rate may be suitably used. When the liquid discharging head 3 is driven, the first circulation pump (high pressure side) 1001 and the first circulation pump 1002 (low pressure side) cause a certain amount of ink to flow in common supply channels 211 and in common recovery channels 212. It is desirable that the flow rate be set to a magnitude that does not allow a temperature difference between recording element boards 10 in the liquid discharging head 3 to influence the image quality. However, when the set value of the flow rate is too large, pressure loss in the channels in the liquid discharging head 3 causes a negative pressure difference between the recording element boards 10 to be too high, as a result of which image density unevenness occurs. Therefore, it is desirable that the flow rate be set by considering the temperature difference and the negative pressure difference between the recording element boards 10.

Negative pressure controlling units 230 are provided in a channel between a second circulation pump 1004 and a liquid discharging unit 300 of the liquid discharging head 3. Therefore, the negative pressure controlling units 230 have the function of, even when a circulation flow rate is changed due to a duty difference for performing recording, maintaining the pressure on a downstream side of the negative pressure controlling units 230 (that is, towards the liquid discharging unit 300) at a certain preset pressure. As two pressure adjusting mechanisms of the negative pressure controlling units 230, any mechanisms may be used as long as they can control the pressure on the downstream side thereof such that the pressure varies within a certain range that is centered on a desired set pressure. As an example of each pressure adjusting mechanism, a mechanism that is similar to a so-called "pressure reducing regulator" may be used. When such a pressure reducing regulator is used, as shown in FIG. 10A, it is desirable that pressure be applied to an upstream side of the negative pressure controlling units 230 by the second circulation pump 1004 via liquid supplying units 220. Such a structure allows the influence of water head pressure of the buffer tank 1003 on the liquid discharging head 3 to be reduced, so that it is possible to lay out the buffer tank 1003 in the recording device 1000 with greater freedom. As the second circulation pump 1004, any circulation pump may be used as long as the lifting height pressure is greater than or equal to a certain pressure within a range of ink circulatory flow rate when the liquid discharging head 3 is driven, and may be, for example, a turbopump or a displacement pump. More specifically, for example, a diaphragm pump may be used. Instead of the second circulation pump 1004, it is possible to use, for example, a water head tank disposed with a certain water head difference with respect to the negative pressure controlling units 230. At the liquid supplying units 220, filters 221 are disposed between the liquid connecting units 111 and the negative pressure controlling units 230.

As shown in FIG. 10A, the negative pressure controlling units 230 include two negative pressure adjusting mechanisms having different set control pressures. The two negative pressure adjusting mechanisms include a mechanism that is set to a relatively high pressure (that is, a high-pressure-set mechanism 230H) and a mechanism that is set to a relatively low pressure (that is, a low-pressure-set mechanism 230L). These negative pressure adjusting mechanisms are connected to the common supply channels 211 and the common recovery channels 212 in the liquid discharging unit 30 via the interiors of the liquid supplying units 220. The liquid discharging unit 300 has the common supply channels 211, the common recovery channels 212, a plurality of individual supply channels 213*a*, and a plurality of individual recovery channels 213*b* that communicate with each recording element board 10. The individual supply channels 213*a* and the individual recovery channels 213*b* communicate with the common supply channels 211 and the common recovery channels 212. Therefore, part of ink passes through an internal channel of each recording element 10 from the common supply channels 211, so that a flow towards the common recovery channels 212 (denoted by arrows in FIG. 10A) is generated. This is because since the pressure adjusting mechanism 230H is connected to the common supply channels 211 and the pressure adjusting mechanism 230L is connected to the common recovery channels 212, a pressure difference occurs between the two common channels.

In this way, in the liquid discharging unit 300, while ink flows so as to pass through the common supply channels 211 and the common recovery channels 212, a flow in which part of the ink passes through each recording element board 10 is generated. Therefore, heat that is generated in each recording element board 10 can be discharged to the outside of each recording element board 10 by the ink that flows through the common supply channels 211 and the common recovery channels 212. In addition, by virtue of such a structure, since a flow of ink can be generated even in the pressure chambers 23 where recording is not performed when recording is being performed by the liquid discharging head 3, it is possible to prevent the ink from being thickened at these portions. In addition, when thickened ink or a foreign substance exists, they can be discharged to the common recovery channels 212. Therefore, the liquid discharging head 3 according to the exemplary embodiment can perform recording at a high speed and with high image quality.

Second Circulation Path

FIG. 10B is a schematic view of a recording device including a second circulation path, which is a circulation path that differs from the above-described first circulation path, as a modification of the exemplary embodiment. The second circulation path mainly differs from the first circulation path as follows. The same structural features as those of the first circulation path are not described below. Two pressure adjusting mechanisms of negative pressure controlling units 230 in the second circulation path both control the pressure on an upstream side of the negative pressure controlling units 230 (that is, at a side opposite to a liquid discharging unit 300) so as to vary within a certain range that is centered on a desired set pressure. An example of each pressure adjusting mechanism is a mechanical component that acts in the same way as a so-called "back pressure regulator". A second circulation pump 1004 acts as a negative pressure source that reduces the pressure on a downstream side of the negative pressure controlling units 230. A first circulation pump (high pressure side) 1001 and a first circulation pump (low pressure side) 1002 are disposed on an upstream side of the liquid discharging head 3, and the negative pressure controlling units 230 are disposed on a downstream side of the liquid discharging head 3.

The negative pressure controlling units 230 in the second circulation path operate such that pressure variations on an upstream side (at the side of the liquid discharging unit 30) are within a certain range that is centered on a preset pressure even when the flow rate varies as a result of a change in duty at the time of recording by the liquid discharging head 3. As shown in FIG. 10B, it is desirable that the second circulation pump 1004 applies a pressure to the downstream side of the negative pressure controlling units 230 via liquid supplying units 220. This makes it possible to reduce the influence of the water head pressure of a buffer tank 1003 on the liquid discharging head 3. Therefore, it is possible to enlarge the range of selection of a layout of the buffer tank 1003 of the recording device 1000. Instead of the second circulation pump 1004, it is also possible to use, for example, a water head tank disposed with a predetermined water head difference with respect to the negative pressure controlling units 230.

As in the first circulation path, the negative pressure controlling units 230 shown in FIG. 10B include two pressure adjusting mechanisms having different set control pressures. These two negative pressure adjusting mechanisms are connected to common supply channels 211 and common recovery channels 212 in the liquid discharging unit 300 via the interiors of the liquid supplying units 220. The two negative pressure adjusting mechanisms cause the pressure of the common supply channels 211 to be relatively higher than the pressure of the common recovery channels 212. By virtue of this structure, a flow of ink towards the common recovery channels 212 via individual channels 213 and an internal channel of each recording element board 10 from the common supply channels 211 is generated (see arrows in FIG. 10B). In this way, a state of flow of ink similar to that in the first circulation path in the liquid discharging unit 300 occurs in the second circulation path in the liquid discharging unit 300.

Comparison Between First Circulation Path and Second Circulation Path

The first circulation path shown in FIG. 10A and the second circulation path (modification) shown in FIG. 10B are compared. A first advantage of the structure of the second circulation path is that in the second circulation path, the negative pressure controlling units 230 are disposed on the downstream side of the liquid discharging head 3, so that the problem that dust and foreign substances produced from the negative pressure controlling units 230 flow into the liquid discharging head 3 is of little concern.

A second advantage is that in the second circulation path, the maximum value of flow rate required to supply liquid from the buffer tank 1003 to the liquid discharging head 3 is smaller than that in the structure including the first circulation path. The reason is as follows. The total of the flow rate in the common supply channels 211 and the flow rate in the common recovery channels 212 when ink circulates during recording standby is assumed as being S. The value S is a minimum flow rate required for making the temperature difference in the liquid discharging unit 300 fall within a desired range when the temperature of the liquid discharging head 3 is adjusted during the recording standby. A discharge flow rate when ink is discharged from all of the discharge ports of the liquid discharging unit 300 (at the time of total discharge) is defined as being F. In the first circulation path (FIG. 10A), the set flow rate of the first circulation pump (high pressure side) 1001 and the set flow rate of the first circulation pump (low pressure side) 1002 are S, and the maximum value of a liquid supply amount to the liquid discharging head 3 required at the time of total discharge is equal to S+F. On the other hand, in the second circulation path (FIG. 10B), a liquid supply amount to the liquid discharging head 3 required at the time of recording standby is equal to a flow rate S, and the supply amount to the liquid discharging head 3 required at the time of total discharge is equal to a flow rate F. For the second circulation path, the total value of the set flow rate of the first circulation pump (high pressure side) 1001 and the set flow rate of the first circulation pump (low pressure side) 1002, that is, the maximum value of the required supply flow rate is the larger one of S and F. As long as the liquid discharging unit 300 having the same structure is used, the maximum value of the required supply flow rate in the second circulation path is always smaller than the maximum value (S+F) of the required supply flow rate in the first circulation path. Therefore, for the second circulation path, a larger variety of circulation pumps can be used. As a result, for example, it is possible to use an inexpensive circulation pump having a simple structure, or to reduce a load on a cooling unit (not shown) that is set in a body path, as a result of which the cost of the recording device body can be reduced. This advantage is particularly effective in a line head having a relatively large S or F value, and is especially effective in a line head that is long in the longitudinal direction.

The structure including the first circulation path is advantageous in terms of image quality. That is, in the second circulation path, since the flow rate at which a liquid flows in the liquid discharging unit 30 becomes a maximum at the time of recording standby, the more an image is like an image that tends to be nonuniform and that has low recording duty, the more likely a high negative pressure is applied near the discharge ports. In particular, when the channel width of the common supply channels 211 and the channel width of the common recovery channels 212 (that is, lengths thereof in a direction orthogonal to the direction of flow of ink) are small and the width of the liquid discharging head (that is, the length thereof in a transverse direction) is small, a high negative pressure is applied near the discharge ports 13 in the case of an image having low duty. As a result, the influence of satellite droplets on the image may be large. In contrast, in the case of the first circulation path, when an image that is unlikely to be nonuniform and that has high duty is to be formed, high negative pressure is applied near the discharge ports 13. Therefore, even if satellite droplets are produced, they are unlikely to be seen, as a result of which the influence of the satellite droplets on the image is small.

As described above, the structure including the first circulation path and the structure including the second circulation path each have strong points and weak points. Therefore, the one that is desirable is selected in accordance with the specification of the liquid discharging head 3 and the recording device body (discharge flow rate F, minimum circulation flow rate S, and internal channel resistance of the head, etc.).

Detailed Structure of Liquid Discharging Head

Figure 11A:
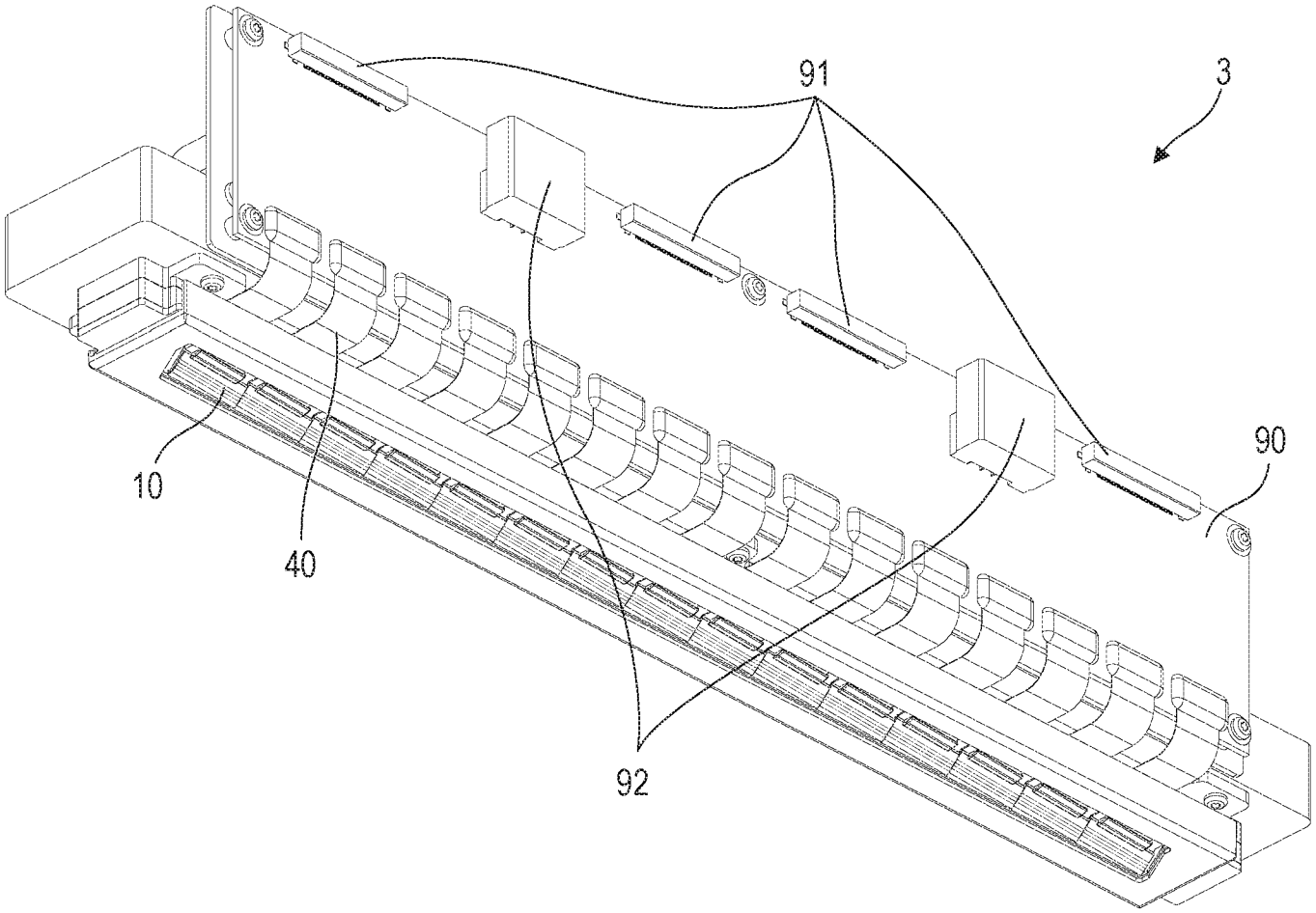
FIGS. 11A and 11B are each a perspective view of a liquid discharging head of the liquid discharging device shown in FIG. 9.
Figure 11B:
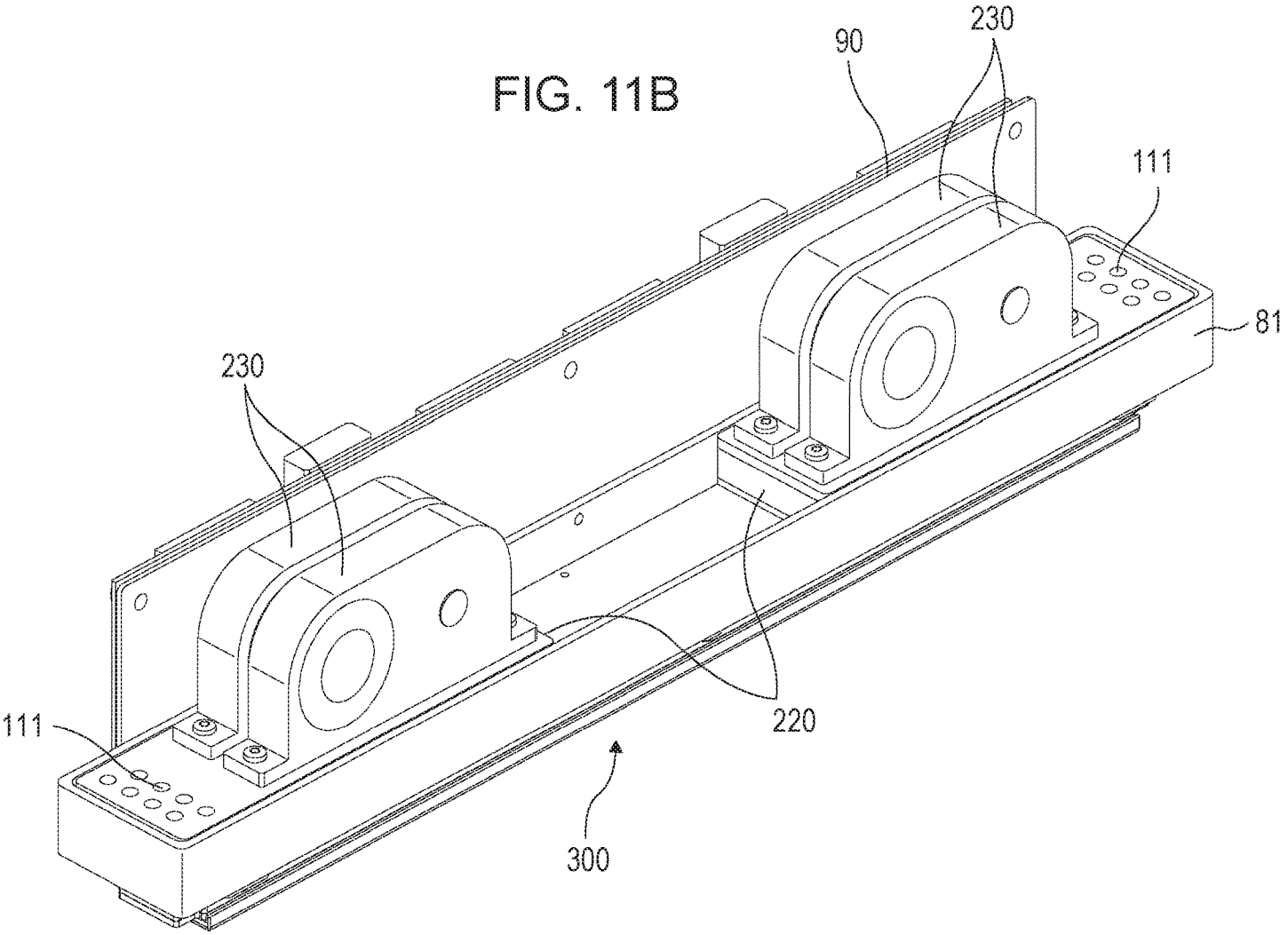

The structure of the liquid discharging head 3 is described in more detail. FIGS. 11A and 11B are each a perspective view of the liquid discharging head 3 according to the exemplary embodiment. The liquid discharging head 3 is a line liquid discharging head in which fifteen recording element boards 10 capable of discharging ink of the four colors (C, M, Y, and K) are arranged in the same line (in-line arrangement). As shown in FIG. 11A, the liquid discharging head 3 includes the plurality of recording element boards 10 and an electrical wiring board 90. Signal input terminals 91, electric power supply terminals 92, and connecting terminals 93 are provided on the electrical wiring board 90. The signal input terminals 91 and the electric power supply terminals 92 are electrically connected to a controller of the recording device body via a connecting portion (not shown), and are electrically to the recording element boards 10 via flexible printed circuit boards 40. Therefore, the electrical wiring board 90 on which the signal input terminals 91 and the electric power supply terminals 92 are provided supplies a discharge drive signal and electric power required for discharge to each of the recording element boards 10. By integrating wires by using an electrical circuit in the electrical wiring board 90, the number of signal input terminals 91 and the number of power supply terminals 92 can be made smaller than the number of recording element boards 10. Therefore, when mounting the liquid discharging head 3 on the recording device body and when replacing the liquid discharging head 3, the number of electrical connecting portions that need to be connected and removed is reduced.

As shown in FIGS. 10A and 10B and FIG. 11B, the liquid connecting units 111 that are provided on respective end portions of the liquid discharging head 3 are connected to a liquid supplying system (schematically shown in FIGS. 10A and 10B) of the recording device body. This allows inks of four colors (C, M, Y, and K) to be supplied to the liquid discharging head from the liquid supplying system of the recording device body, and the inks that have passed through the liquid discharging head 3 to be recovered by the liquid supplying system of the recording device body. In this way, the inks of the corresponding colors can circulate by passing through the channels in the recording device body and the channels in the liquid discharging head 3.

Figure 12:
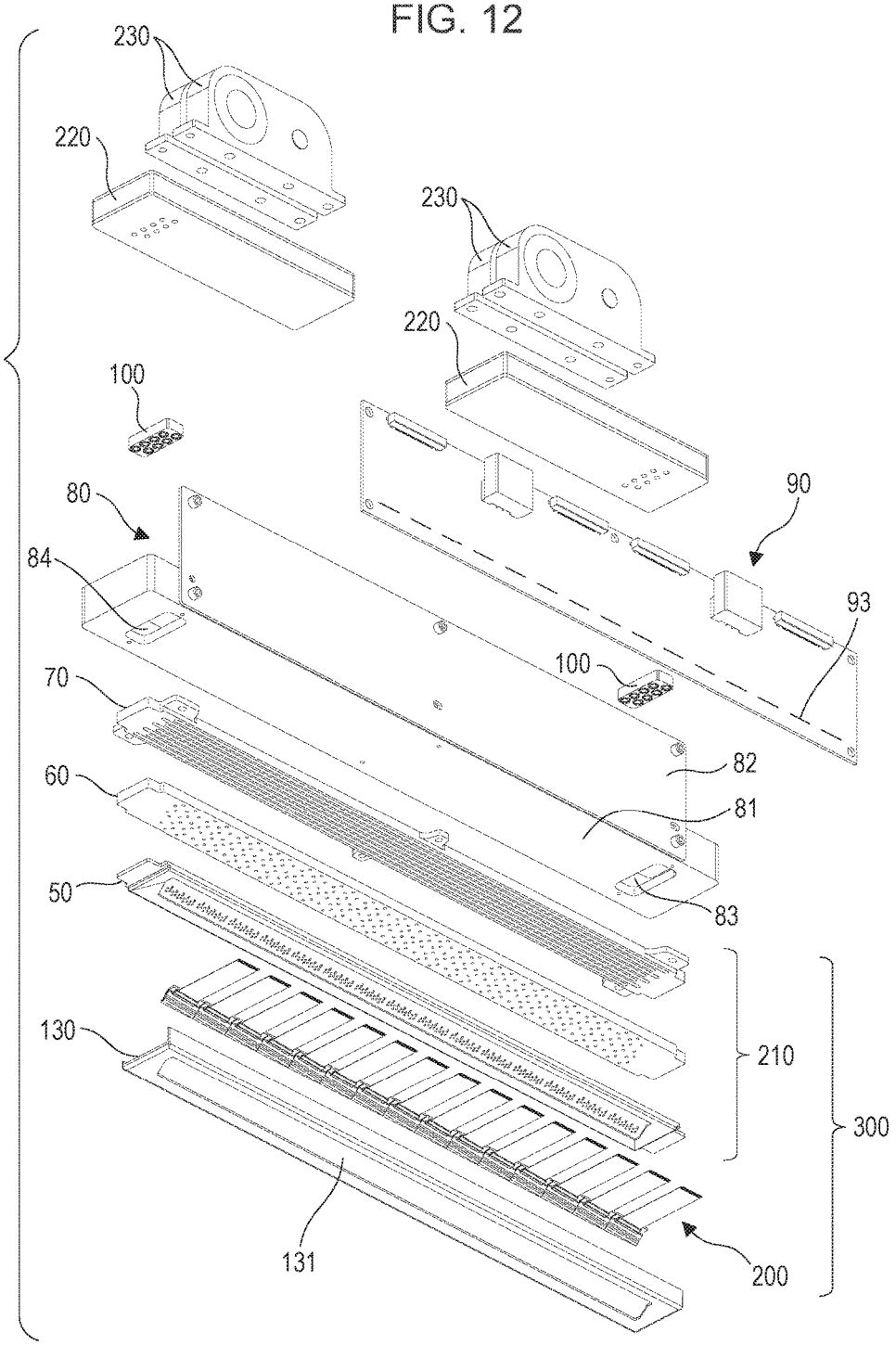
FIG. 12 is an exploded perspective view of the liquid discharging head shown in FIGS. 11A and 11B.

FIG. 12 is an exploded perspective view of each component and unit of the liquid discharging head 3. The liquid discharging unit 300, the liquid supplying units 220, and the electrical wiring board 90 are mounted on a housing 80. The negative pressure controlling units 230 are mounted on the liquid supplying units 220. The liquid connecting units 111 (FIGS. 10A and 10B and FIGS. 11A and 11B) are provided at the liquid supplying units 220. In order to remove foreign substances in the ink that is supplied, the filters 221 (FIGS. 10A and 10B) for corresponding colors are provided in the liquid supplying units 220 so as to be disposed in paths that communicate with openings in the liquid connecting units 111. Two liquid supplying units 220 each include a filter for two corresponding colors. The inks that have passed through the filters 221 are supplied to the negative pressure controlling units 230 on the liquid supplying units 220 in correspondence with the ink colors. The negative pressure controlling units 230 include pressure adjusting valves for the corresponding colors. By the action of spring members and the valves in the negative pressure controlling units 230, variations in pressure loss that occur in the liquid supplying system of the recording device body (that is, the liquid supplying system disposed on the upstream side of the liquid discharging head 3) due to variations in the flow rate of ink are considerably reduced. Therefore, the negative pressure controlling units 230 stabilize the pressure such that changes in the negative pressure on the downstream side thereof (that is, at the side of the liquid discharging unit 300) fall within a certain range. As shown in FIGS. 10A and 10B, two pressure adjusting valves for corresponding colors are built in the negative pressure controlling units 230 for the corresponding colors. These pressure adjusting valves are set to different control pressures, the high pressure side being connected to the common supply channels 211 in the liquid discharging unit 300 and the low pressure side being connected to the common recovery channels 212 via the liquid supplying units 220.

The housing 80 includes a liquid discharging unit supporting portion 81 and an electrical wiring board supporting portion 82, supports the liquid discharging unit 300 and the electrical wiring board 90, and provides the rigidity of the liquid discharging head 3. The electrical wiring board supporting portion 82 is secured to the liquid discharging unit supporting portion 81 by screws, and supports the electrical wiring board 90. The liquid discharging unit supporting portion 81 corrects warping and deformation of the liquid discharging unit 300 and causes the plurality of recording element boards 10 to be precisely positioned relative to each other, thereby reducing the occurrence of streaks and non-uniformity in a recorded material caused by the discharge of ink. Therefore, it is desirable that the liquid discharging unit supporting portion 81 be sufficiently rigid. Suitable materials of the liquid discharging unit supporting portion 81 include metal materials, such as stainless steel (SUS) and aluminum, or ceramic materials, such as alumina. The liquid discharging unit supporting portion 81 has openings 83 and 84 in which joint rubbers 100 are inserted. Ink that is supplied from the liquid supplying units 220 is guided to a third channel member 70 of the liquid discharging unit 300 via the joint rubbers.

The liquid discharging unit 300 includes a plurality of discharge modules 200 and a channel member 210. A cover member 130 is mounted on a recording-medium-side surface of the liquid discharging unit 300. The cover member 130 is a member having a frame-shaped surface having a long opening 131. The recording element boards 10 and sealing materials 110 (see FIGS. 14A and 14B) of the discharge modules 200 are exposed from the opening 131. A frame portion surrounding the opening 131 functions as a contact surface of a cap member that seals the liquid discharging head 3 at the time of recording standby. Therefore, it is desirable that a closed space be formed at the time of capping by applying an adhesive, a sealing material, or a filling material to a portion around the opening 131 and filling an uneven portion or a gap in discharge port surfaces of the liquid discharging unit 300.

Next, a structure of the channel member 210 of the liquid discharging unit 300 is described. As shown in FIG. 12, the channel member 210 is a multilayer body including a first channel member 50, a second channel member 60, and the third channel member 70. The channel member 210 distributes ink supplied from the liquid supplying units 220 to the discharge modules 200 or returns the ink that returns from the discharge modules 200 to the liquid supplying units 220. The channel member 210 is screwed to the liquid discharging unit supporting portion 81, and is prevented from being warped and deformed by the housing 80.

Figure 13A:
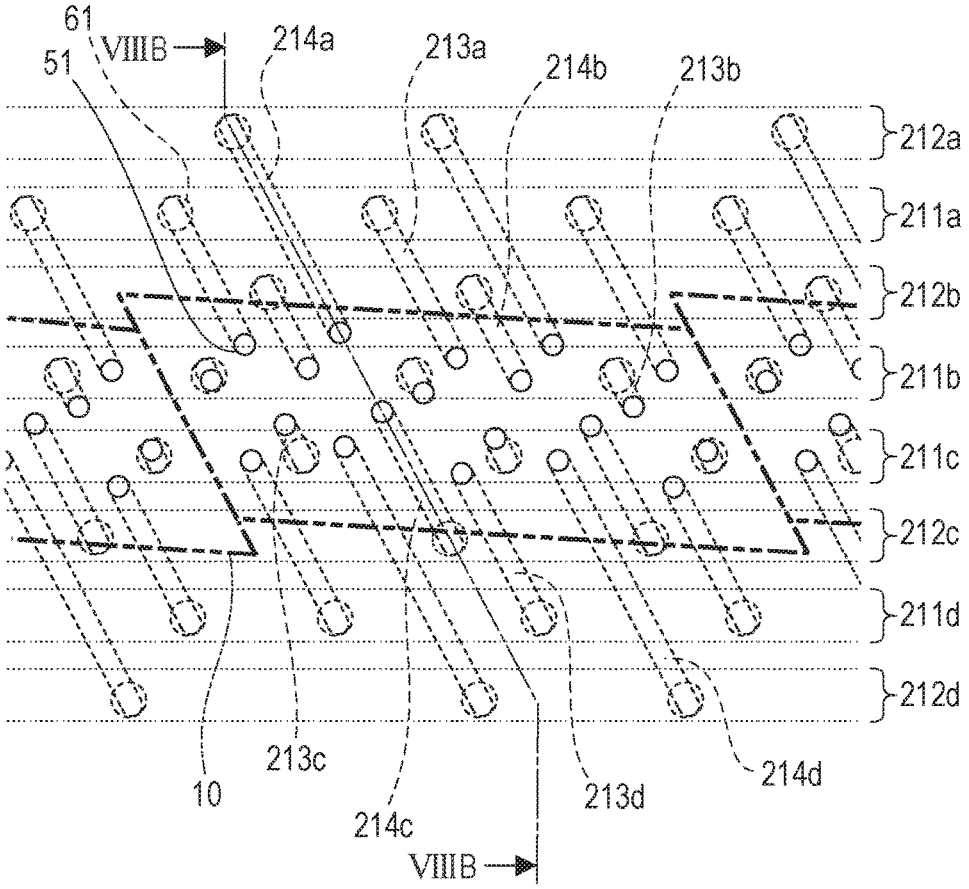
FIGS. 13A and 13B are respectively a perspective view and a sectional view showing the relationship between connections of channels of the liquid discharging head shown in FIGS. 11A and 11B.
Figure 13B:
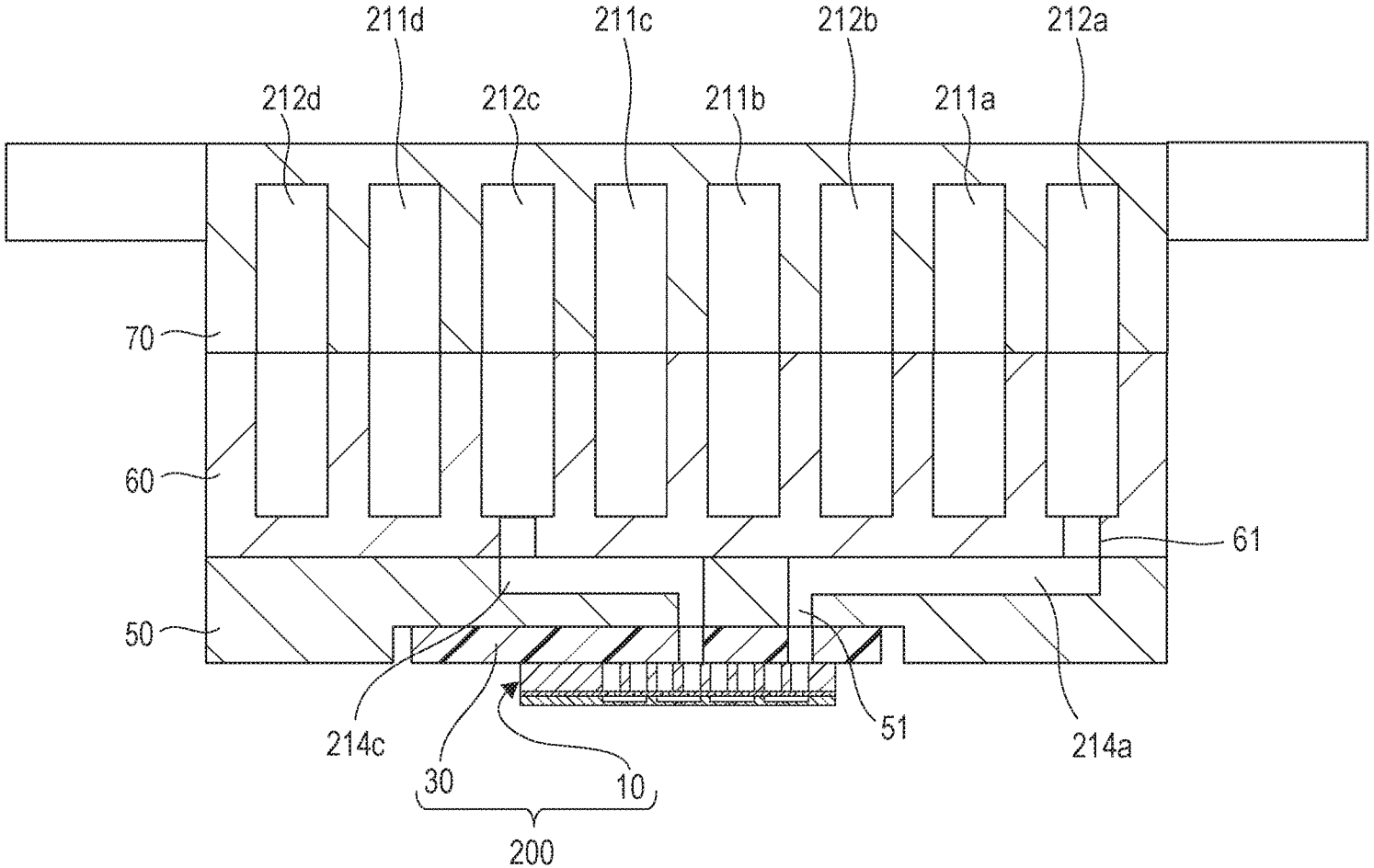

The relationship between connections of channels in the channel member 210 is described by using FIGS. 13A and 13B. FIG. 13A is a partial enlarged perspective view of the channels in the channel member 210, formed by joining the first channel member 50, the second channel member 60, and the third channel member 70, when seen from a side of a surface of the first channel member 50 on which the discharge modules 200 are mounted. The common supply channels 211 (211*a*, 211*b*, 211*c*, and 211*d*) extending in the longitudinal direction of the liquid discharging head 3 and the common recovery channels 212 (212*a*, 212*b*, 212*c*, and 212*d*) are provided in the channel member 210 in accordance with corresponding colors. The plurality of individual supply channels 213*a*, 213*b*, 213*c*, and 213*d*, formed by individual channel grooves, are connected to the common supply channels 211 for the corresponding colors via communicating ports 61. A plurality of individual recovery channels 214*a*, 214*b*, 214*c*, and 214*d*, formed by individual channel grooves, are connected to the common recovery channels 212 for the corresponding colors via the communicating ports 61. By virtue of such a channel structure, it is possible to concentrate the ink at the recording element boards 10, which are positioned at a central portion of the channel member 210, via the individual supply channels 213 from the corresponding common supply channels 211. In addition, it is possible to recover the ink to each common recovery channel 212 via the individual recovery channels 214 from the recording element boards 10.

FIG. 13B is a sectional view taken along line XIIIB-XIIIB in FIG. 13A. As shown in FIG. 13B, the individual recovery channels 214*a* and 214*c* are connected to the discharge modules 200 via the communicating ports 51. FIG. 13B only illustrates the individual recovery channels 214*a* and 214*c*. However, FIG. 13A, which is a different sectional view, shows that the individual supply channels 213 and the discharge modules 200 are connected to each other. Channels for supplying ink from the first channel member 50 to the recording elements 15 (see FIGS. 15A to 15C) of the recording element boards 10 are formed in supporting members 30 and the recording element boards 10 of the discharge modules 200. The channels for recovering (returning) some or all of the ink supplied to the recording elements 15 to the first channel member 50 are formed in the supporting members 30 and the recording element boards 10. The common supply channels 211 for the corresponding colors are connected to the high pressure side of the negative pressure controlling unit 230 for the corresponding colors via the liquid supplying units 220. The common recovery channels 212 are connected to the low pressure side of the negative pressure controlling unit 230 via the liquid supplying units 220. The negative pressure controlling units 230 cause a pressure difference to occur between the common supply channels 211 and the common recovery channels 212. Therefore, in the liquid discharging head 3 according to the exemplary embodiment in which the channels are connected as shown in FIGS. 13A and 13B, ink flows from the common supply channels 211 to the individual supply channels 213*a*, the recording element boards 10, the individual recovery channels 213*b*, and the common recovery channels 212 in that order for the corresponding colors.

Discharge Modules

Figure 14A:
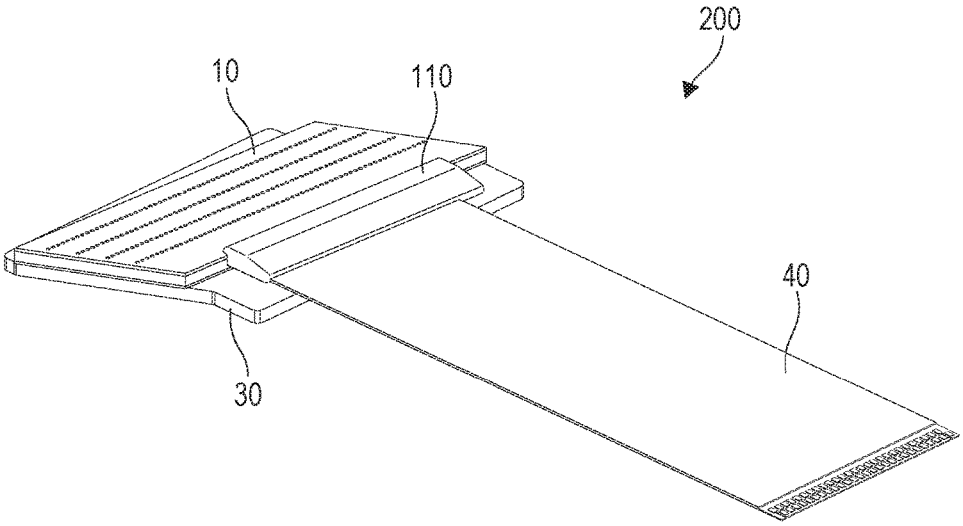
FIGS. 14A and 14B are respectively a perspective view and an exploded perspective view of a discharge module of the liquid discharging head shown in FIGS. 11A and 11B.
Figure 14B:
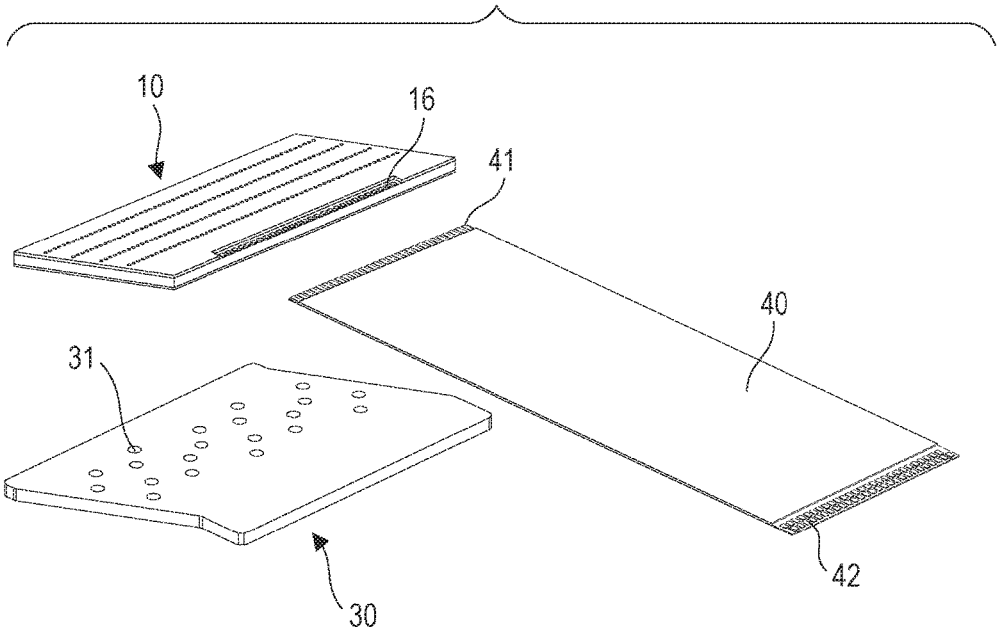

FIG. 14A is a perspective view of one discharge module 200 and FIG. 14B is an exploded perspective view thereof. In the discharge module 200, a recording element board 10 and a flexible printed circuit board 40 are previously bonded to a supporting member 30 having liquid communicating ports 31. In addition, terminals 16 on the recording element board 10 are electrically connected to terminals 41 on the flexible printed circuit board 40 by wire bonding, and a wire bonding portion (electrical connection portion) is covered and sealed by a sealing material 110. Connecting terminals 42 on the flexible printed circuit board 40 that are disposed opposite to the recording element board 10 are electrically connected to connecting terminals 93 (see FIG. 12) on the electrical wiring board 90. Since the supporting member 30 is a supporting member that supports the recording element board 10 and is a channel member that connects the recording element board 10 and the channel member 210 so as to allow circulation of a liquid, it is desirable that the supporting member 30 be one which has high flatness and which can be joined to the recording element board 10 with a sufficient level of reliability. It is desirable that the supporting member 30 be made of, for example, alumina or a resin material.

Structure of Recording Element Board

Figure 15A:
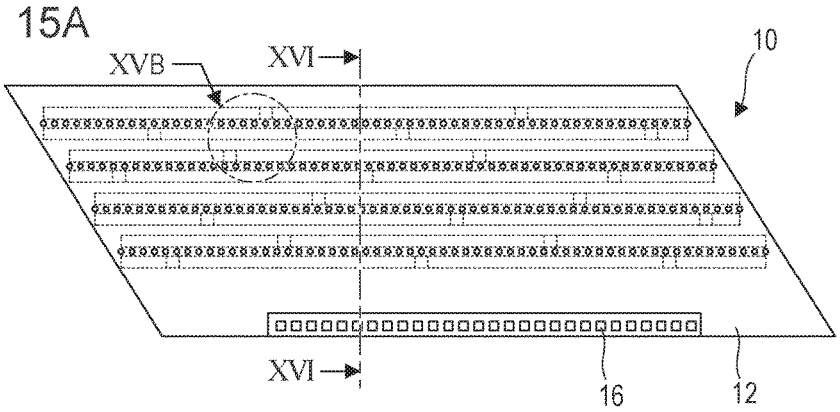
FIGS. 15A and 15C are plan views and FIG. 15B is a back view of a recording element board of the liquid discharging head shown in FIGS. 11A and 11B.
Figure 15B:
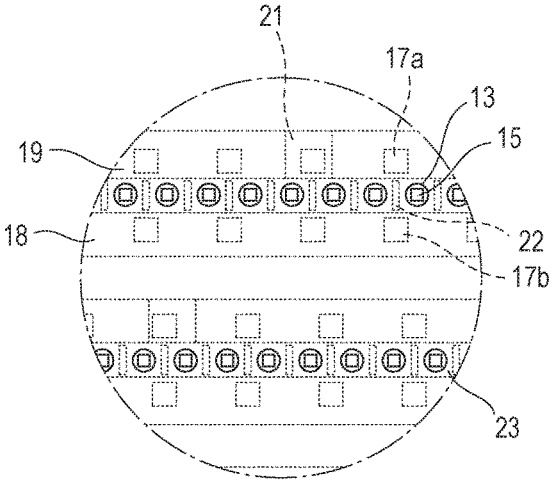
Figure 15C:
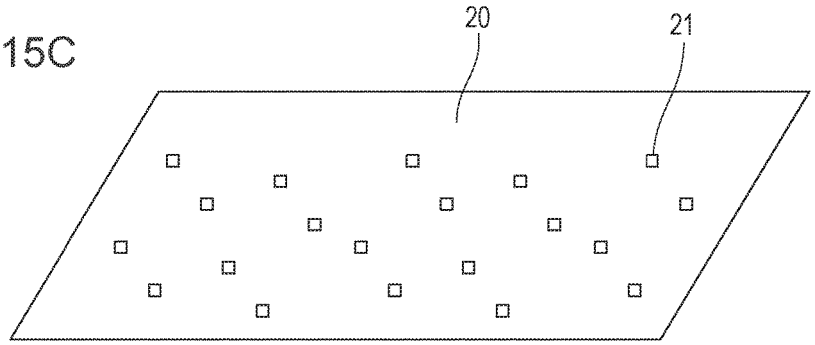
Figure 16:
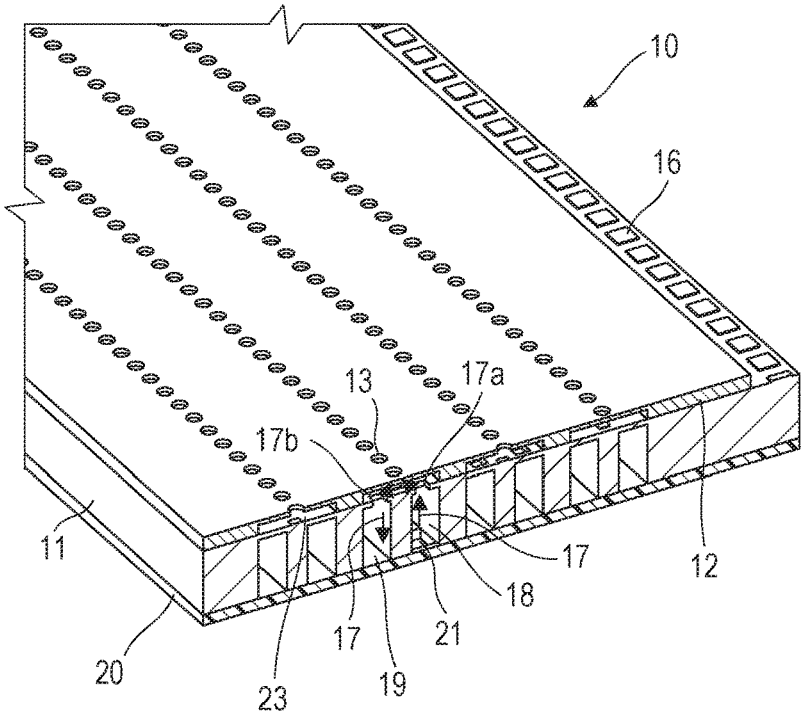
FIG. 16 is a perspective view of a section along line XVI-XVI in FIG. 15A.

A structure of each recording element board 10 according to the exemplary embodiment is described. FIG. 15A is a plan view of one recording element board 10 when seen from a side where discharge ports 13 are formed. FIG. 15B is an enlarged view of a portion XVB in FIG. 15A. FIG. 15C is a back view of a side opposite to that of FIG. 15A. FIG. 16 is a sectional perspective view of one recording element board 10 and a cover member (cover plate) 20 taken along line XVI-XVI in FIG. 15A. As shown in FIG. 14A, four rows of discharge ports corresponding to inks of corresponding colors are formed in the discharge port forming member 12 of the recording element board 10. A direction in which the rows of discharge ports 13 extend is called "discharge port row direction".

As shown in FIG. 15B, recording elements 15, such as heating resistance elements, that generate thermal energy for bubbling ink are disposed at locations opposing the corresponding discharge ports 13. Partitions 22 form a plurality of pressure chambers 23 including the recording elements 15 therein. Electrical wires (not shown) that are provided on the recording element board 10 electrically connect the recording elements 15 and the terminals 16 shown in FIG. 15A. On the basis of a pulse signal that is input from a control circuit of the recording device body via the electrical wiring board 90 (see FIG. 12) and the flexible wiring board 40 (see FIGS. 14A and 14B), ink is heated to boil the ink. Bubbling force resulting from the boiling of the ink causes the ink to be discharged from the discharge ports 13. As shown in FIG. 15B, a liquid supply path 18 is formed on one side of its corresponding discharge port row and a liquid recovery path 19 is disposed on the other side of its corresponding discharge port row so as to extend along the corresponding discharge port row. The liquid supply paths 18 and the liquid recovery paths 19 are channels that are provided in the recording element board 10 and that extend in a direction of the corresponding discharge port row, and communicate with the discharge ports 13 via the supply paths 17*a* and the recovery paths 17*b*.

As shown in FIGS. 15A to 15C and FIG. 16, a sheet-like cover member (cover plate) 20 is placed on a back surface of the recording element board 10 in which the discharge ports 13 are formed, and a plurality of openings 21 that are connected to the liquid supply paths 18 and the liquid recovery paths 19 (described below) are formed in the cover member 20. In the exemplary embodiment, three openings 21 are formed in one liquid supply path 18, and two openings 21 are formed in one liquid recovery path 19. As shown in FIG. 15B, the openings 21 in the cover member 20 communicate with the communicating ports 51 (see FIG. 13A). As shown in FIG. 16, the cover member 20 functions as a cover that forms parts of walls of the liquid supply paths 18 and the liquid recovery paths 19 that are formed in the substrate 11 which constitutes the recording element board 10. It is desirable that the cover member 20 have sufficient corrosion resistance against ink. From the viewpoint of preventing color mixtures, the shapes of the openings 21 need to be precisely formed, and the openings 21 need to be precisely positioned. Therefore, it is desirable to use a photosensitive resin or a silicon plate as the material of the cover member 20 and form the openings 21 therein by a photolithography process. Accordingly, the cover member 20 is one that changes the pitch of the channels due to the openings 21, and is desirably thin and is a film member when pressure loss is considered.

The recording element board 10 has a structure in which, for example, the substrate 11 made of Si and the discharge port forming member 12 made of a photosensitive resin are placed upon each other, and in which the cover member 20 is joined to the back surface of the substrate 11. The recording elements 15 are formed on one side (that is, the side of the discharge port forming member 12) of the substrate 11, and grooves that constitute the liquid supply paths 18 and the liquid recovery paths 19 extending along the discharge port rows are formed at the back side (that is, the side of the cover member 20) of the substrate 11. The liquid supply paths 18 and the liquid recovery paths 19 formed by the cover member 20 and the substrate 11 are connected to the common supply channels 211 and the common recovery channels 212 in the channel member 210, and a pressure difference occurs between the liquid supply paths 18 and the liquid recovery paths 19. In the exemplary embodiment, a recording element board 10 having discharge ports 13 that are provided with protrusions 13*a* as exemplified in FIGS. 1A to 1D, FIGS. 4A to 4C, FIGS. 5A to 5C, and FIGS. 6A to 6C is provided.

The flow of ink in a recording element board 10 is described. The aforementioned pressure difference causes the flow 17 towards the liquid recovery paths 19 from the liquid supply paths 18 in the substrate 11 to be generated. Therefore, when discharging ink from some of the discharge ports 13 of the liquid discharging head 3, even in the discharge ports 13 that are not performing a discharge operation, the flow 17 of ink in the liquid supply paths 18 is generated in the direction of the arrows. That is, the ink in the liquid supply paths 18 flows to the liquid recovery paths 19 via the supply paths 17*a*, the pressure chambers 23, and the recovery paths 17*b*. When, for example, foreign substances, bubbles in the ink, or thickened ink produced by evaporation from the discharge ports 13 exists, the flow 17 allows them to be recovered by the liquid recovery paths 19. In addition, it is possible to reduce the thickening of the ink in the pressure chambers 23 and the discharge ports 13. The ink that has been recovered by the liquid recovery paths 19 passes through the openings 21 of the cover member 20 and the liquid communicating ports 31 (see FIG. 14B) of the supporting member 30, and are recovered via the communicating ports 51, the individual recovery channels 214, and the common recovery channels 212 in the channel member 210 shown in FIGS. 13A and 13B. The ink is finally guided to a supply channel of the recording device body.

In this way, in the exemplary embodiment, the ink that is supplied to the liquid discharging head 3 from the recording device body flows into the channel member 210 and the recording element board 10 in the following order in order to be supplied and recovered. The ink flows into the liquid discharging head 3 from the liquid connecting units 111 (see FIG. 11) of the liquid supplying units 220. Then, the ink flows through the join rubbers 100 (see FIG. 12), communicating ports and common channel grooves in the third channel member 70, common channel grooves and the communicating ports 61 (see FIGS. 13A and 13B) in the second channel member 60, and individual channel grooves 52 and the communicating ports 51 in the first channel member 50 in that order. Thereafter, the ink is supplied to the pressure chambers 23 as a result of passing through the liquid communicating ports 31 (see FIG. 14B) in the supporting member 30, the openings 21 in the cover member 20 (see FIGS. 15A to 16), and the liquid supply paths 18 and the supply paths 17*a* in the substrate 11 in that order. Of the ink in the pressure chambers 23, the ink that is not discharged from the discharge ports 13 flows through the recovery paths 17*b* and the liquid recovery paths 19 in the substrate 11, the openings 21 in the cover member 20, and the liquid communicating ports 31 in the supporting member 30 in that order. Thereafter, the ink flows through the communicating ports 51 and individual channel grooves in the first channel member 50, the communicating ports 61 and the common channel grooves in the second channel member, the common channel grooves and the communicating ports in the third channel member 70, and the joint rubbers 100 in that order. Further, the ink flows from the liquid connecting units 111 of the liquid supplying units 220 to the outside of the liquid discharging head 3.

The flow of ink in the channel member 210 and the recording element board 10 has been described above. A supplementary explanation is given regarding the flow of ink in front of and behind the channel member 210 and the recording element board 10. In the first circulation path shown in FIG. 10A, ink that has flown into the liquid discharging head 3 via the liquid connecting units 111 from the recording device body is supplied to the third channel member 70 from the joint rubbers 100 (see FIG. 12) via the filters 221 and the negative pressure controlling units 230. Then, as described above, after flowing through the channel member 210 and the recording element board 10, the ink returns to the recording device body from the liquid connecting units 111.

On the other hand, in the second circulation path shown in FIG. 10B, ink that has flown into the liquid discharging head 3 via the liquid connecting units 111 from the recording device body is supplied to the third channel member 70 from the joint rubbers 100 (see FIG. 12) via the filters 221. Then, as described above, after flowing through the channel member 210 and the recording element board 10, the ink passes through the joint rubbers 100 and flows into the negative pressure controlling units 230. Thereafter, the ink returns to the recording device body from the liquid connecting units 111.

As shown in FIGS. 10A and 10B, not all of the ink that has flown in from one end of each common supply channel 211 of the liquid discharging unit 300 is supplied to the pressure chambers 23 via the individual supply channels 213*a*. Some of the ink flows into the liquid supplying units 220 after flowing from one end to the other end of each common supply channel 211 without flowing into the individual supply channels 213*a*. In this way, when there are channels through which ink flows without passing through the recording element boards 10, even if the structure includes the recording element boards 10 that have fine channels having high flow resistance as in the exemplary embodiment, it is possible to reduce reverse circulatory flow of the ink. In the liquid discharging head according to the exemplary embodiment, this makes it possible to reduce the thickening of ink near the discharge ports and the pressure chambers, so that it is possible to reduce displacements from a normal discharge direction and improper discharge, as a result of which high-quality recording can be performed.

Positional Relationship Between a Plurality of Recording Element Boards

Figure 17:
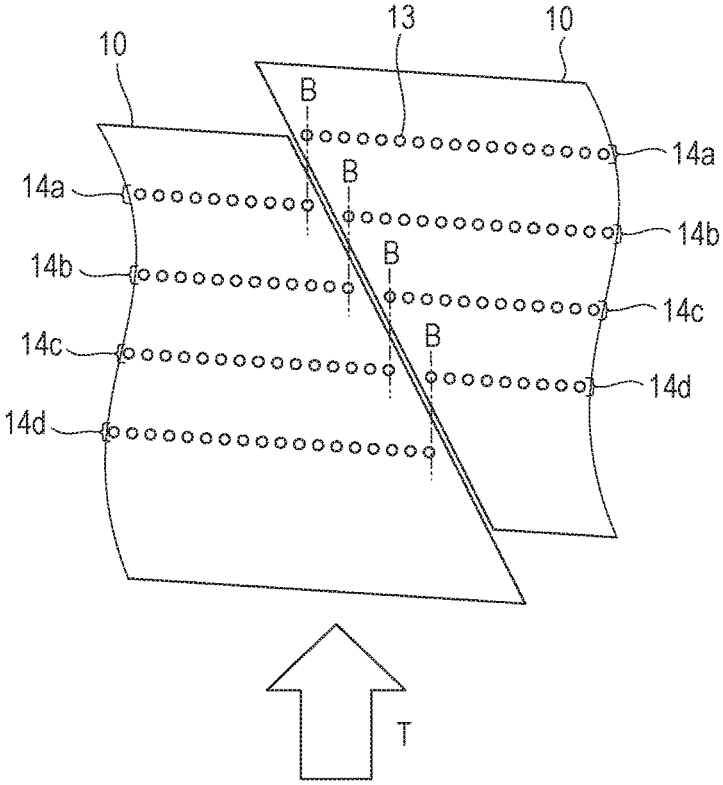
FIG. 17 is a plan view of a joint between adjacent recording element boards of the liquid discharging head shown in FIGS. 11A and 11B.

FIG. 17 is an enlarged plan view of adjacent portions of two adjacent recording element boards 10. As shown in FIG. 17, in the exemplary embodiment, recording element boards 10 having planar shapes that are substantially parallelogram shapes are used. In each recording element board 10, discharge port rows 14*a* to 14*d* each including a plurality of discharge ports 13 that are arranged are disposed so as to be tilted at a certain angle with respect to a recording medium conveying direction T. By this, at the adjacent portions of the recording element boards 10, at least one discharge port of a discharge port row and at least one discharge port of the adjacent recording element board 10 overlap each other in the recording medium conveying direction. In FIG. 17, two discharge ports overlap each other on a straight line B. By virtue of such a disposition, even if the positions of the recording element boards 10 are slightly displaced from their predetermined positions, it is possible to prevent black streaks and white spots of a recorded image from standing out by controlling driving at the discharge ports that overlap each other. Even if the plurality of recording element boards 10 are disposed in a straight line (in-line arrangement) instead of in a staggered arrangement, it is possible to form a structure such as that shown in FIG. 17. This makes it possible to reduce the occurrence of black streaks and white spots at a joint between the recording element boards 10 while reducing an increase in the length of the liquid discharging head 10 in the recording medium conveying direction T. Although in the exemplary embodiment, the planar shape of each recording element board 10 is a parallelogram shape, the present disclosure is not limited thereto. The structure according to the present disclosure is desirably applicable to cases where the planar shape of each recording element board is, for example, a rectangular shape or a trapezoidal shape.

Second Exemplary Embodiment of Liquid Discharging Device

An inkjet recording device 1000 and a liquid discharging head 3 according to a second exemplary embodiment of the present disclosure is described. In the description below, primarily, only portions that differ from those according to the first exemplary embodiment are described, and similar portions to those according to the first exemplary embodiment are not described.

Inkjet Recording Device

Figure 18:
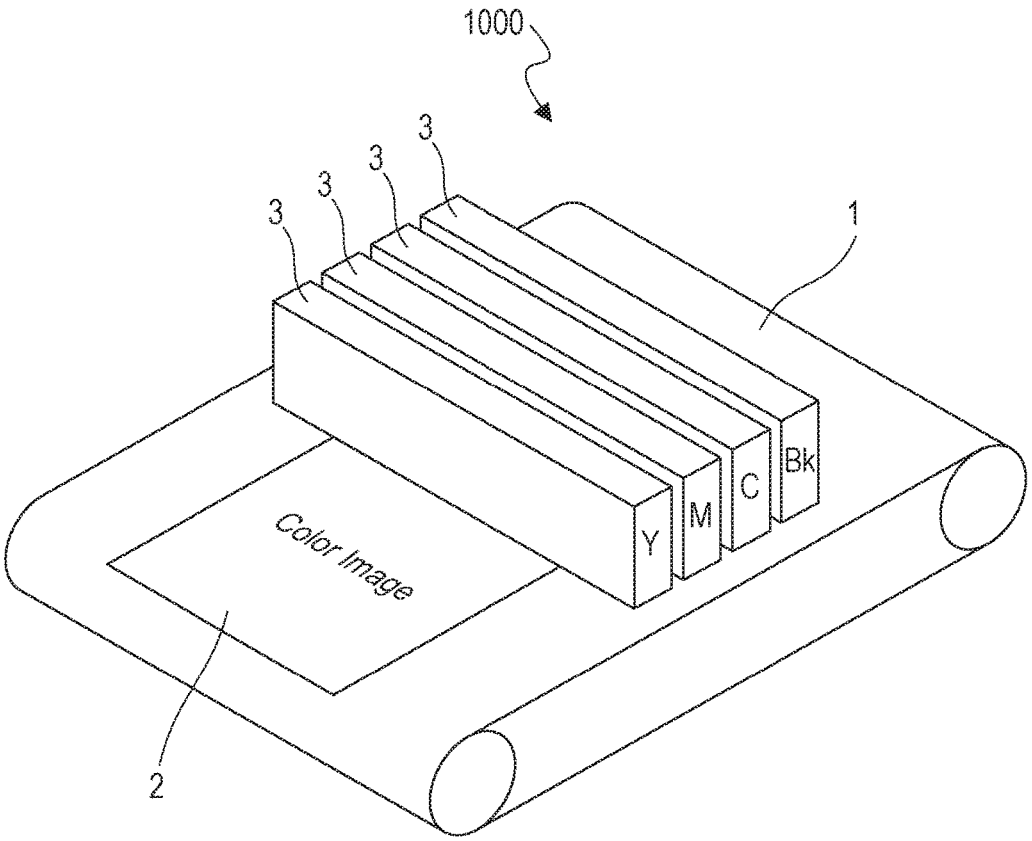
FIG. 18 is a perspective view of a main portion of a liquid discharging device according to a second exemplary embodiment of the present disclosure.

The inkjet recording device 1000 shown in FIG. 18 differs from that according to the first exemplary embodiment in that four single-color liquid discharging heads 3 are arranged in correspondence with inks of four colors, that is, C, M, Y, and K, to perform full-color recording on a recording medium. In the first exemplary embodiment, one discharge port row is used per color, whereas, in the second exemplary embodiment, 20 discharge port rows are used per color (see FIG. 24). Therefore, it is possible to perform recording at a very high speed by appropriately allocating recording data to a plurality of discharge port rows. Further, even if there is a discharge port that cannot discharge liquid due to some trouble, the liquid can be discharged in a supplementary manner from a discharge port of another discharge port of a discharge port row that overlaps the discharge port that cannot discharge the liquid in the recording medium conveying direction in order to perform a desired recording operation. In this way, according to the second exemplary embodiment, the reliability with which recording is performed by discharging the liquid is increased, as a result of which the structure according to the second exemplary embodiment is suitable for, for example, commercial printing.

As in the first exemplary embodiment, a buffer tank 1003 and a main tank 1006 (see FIG. 10) of a liquid supplying system of a recording device body are connected to each liquid discharging head 3 so as to allow circulation of a liquid. An electricity controller that transmits electric power and a discharge control signal is electrically connected to each liquid discharging head 3.

Circulation Paths

As liquid circulation paths that are disposed between the recording device body and the liquid discharging heads 3, as in the first exemplary embodiment, the first circulation path shown in FIG. 10A and the second circulation path shown in FIG. 10B may be used.

Liquid Discharging Heads

Figure 19A:
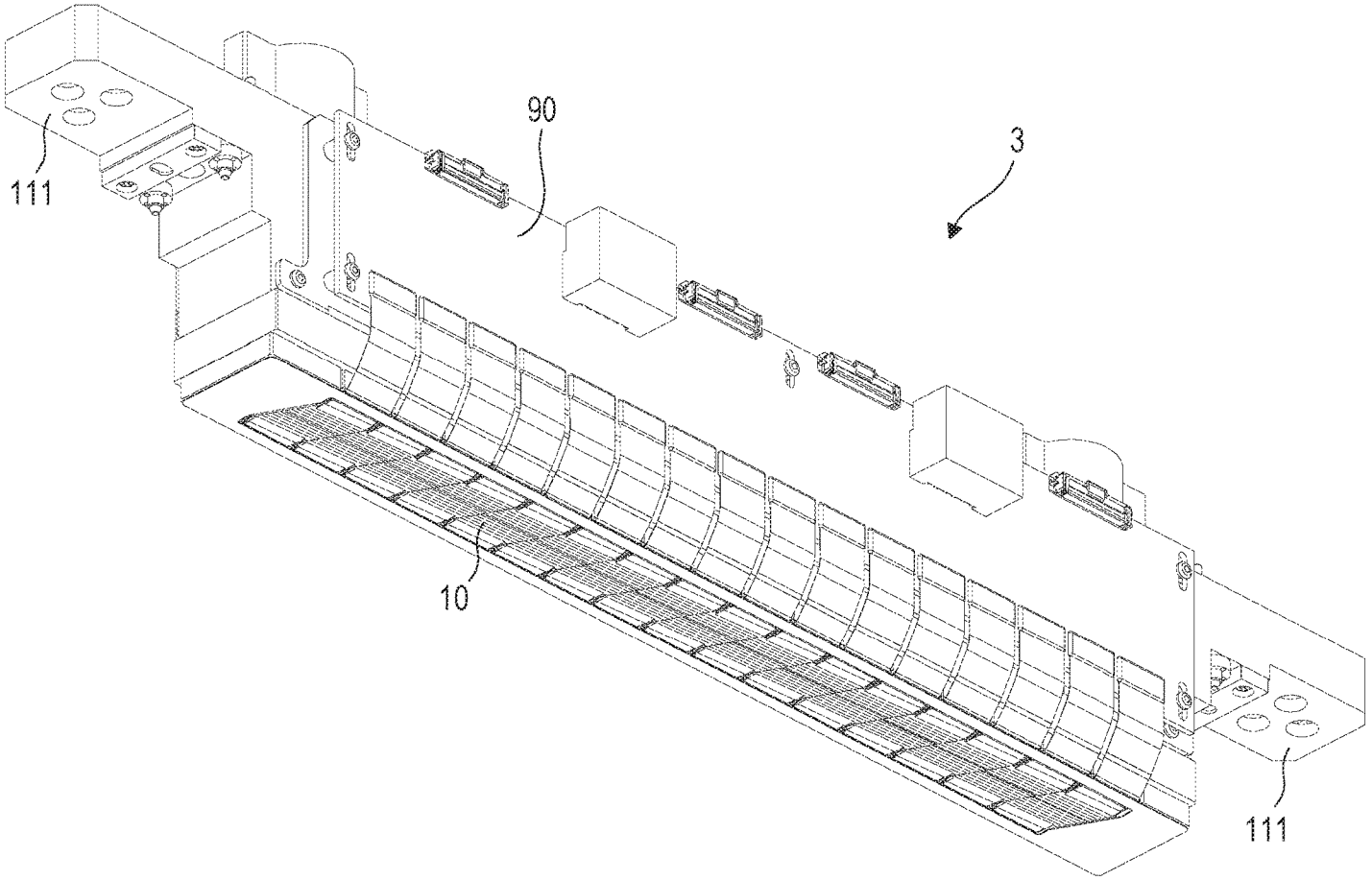
FIGS. 19A and 19B are each a perspective view of a liquid discharging head of the liquid discharging device shown in FIG. 18.
Figure 19B:
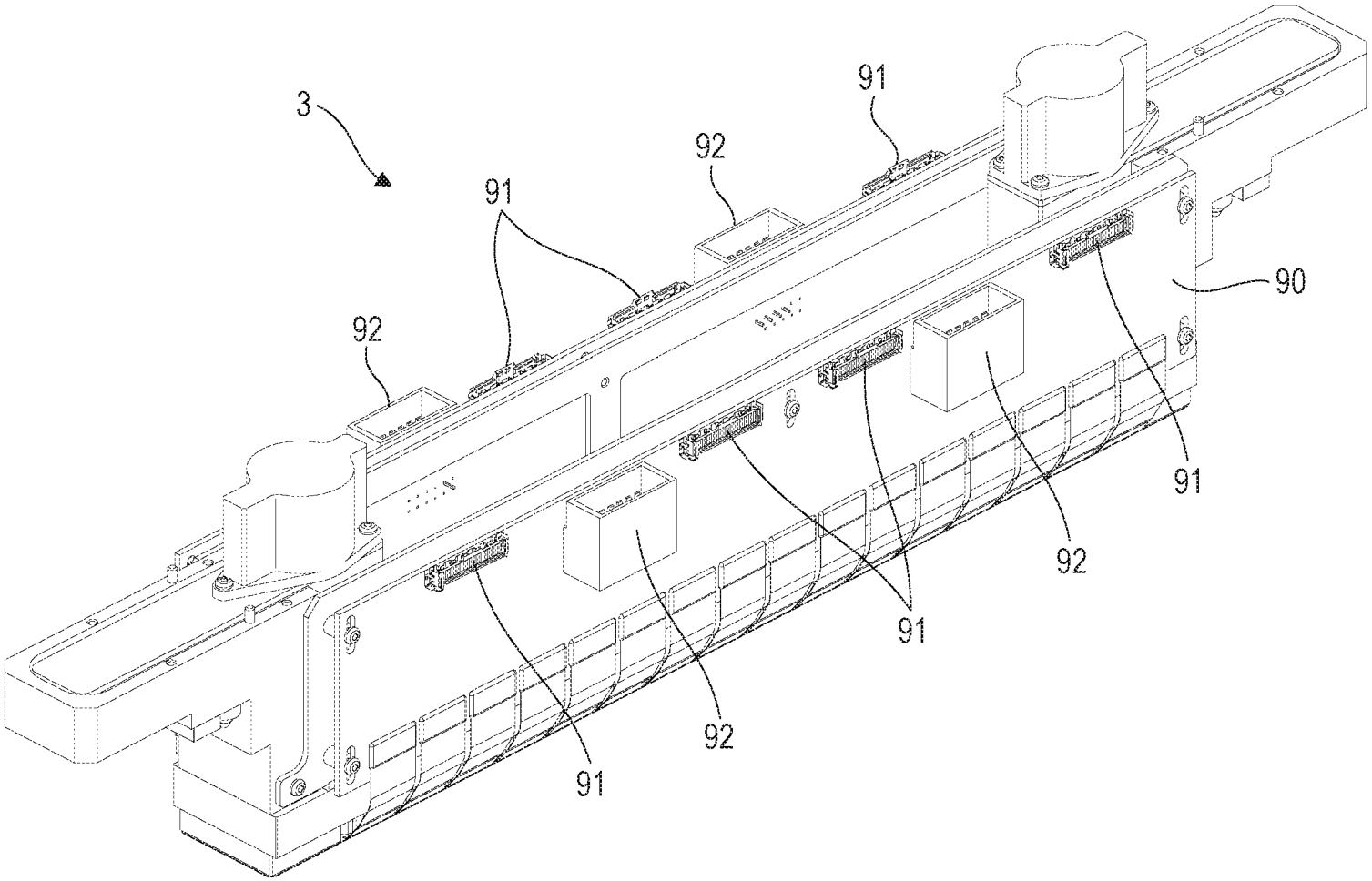

The inkjet recording device according to the exemplary embodiment shown in FIG. 18 includes four liquid discharging heads 3. A perspective view of each liquid discharging head 3 is shown in FIGS. 19A and 19B. Each liquid discharging head 3 includes 16 recording element boards 10 that are arranged in a straight line in the longitudinal direction, and is an inkjet line recording head that performs recording using ink of one color. As in the first exemplary embodiment, each liquid discharging head 3 includes liquid connecting units 111, signal input terminals 91, and electric power supply terminals 92. However, since each liquid discharging head according to the exemplary embodiment has a larger number of discharge port rows than in the first exemplary embodiment, the signal input terminals 91 and the electric power supply terminals 92 are disposed on both sides of each liquid discharging head 3. This is to reduce a delay in signal transmission and a reduction in voltage caused by wiring portions that are provided at the recording element boards 10.

Figure 20:
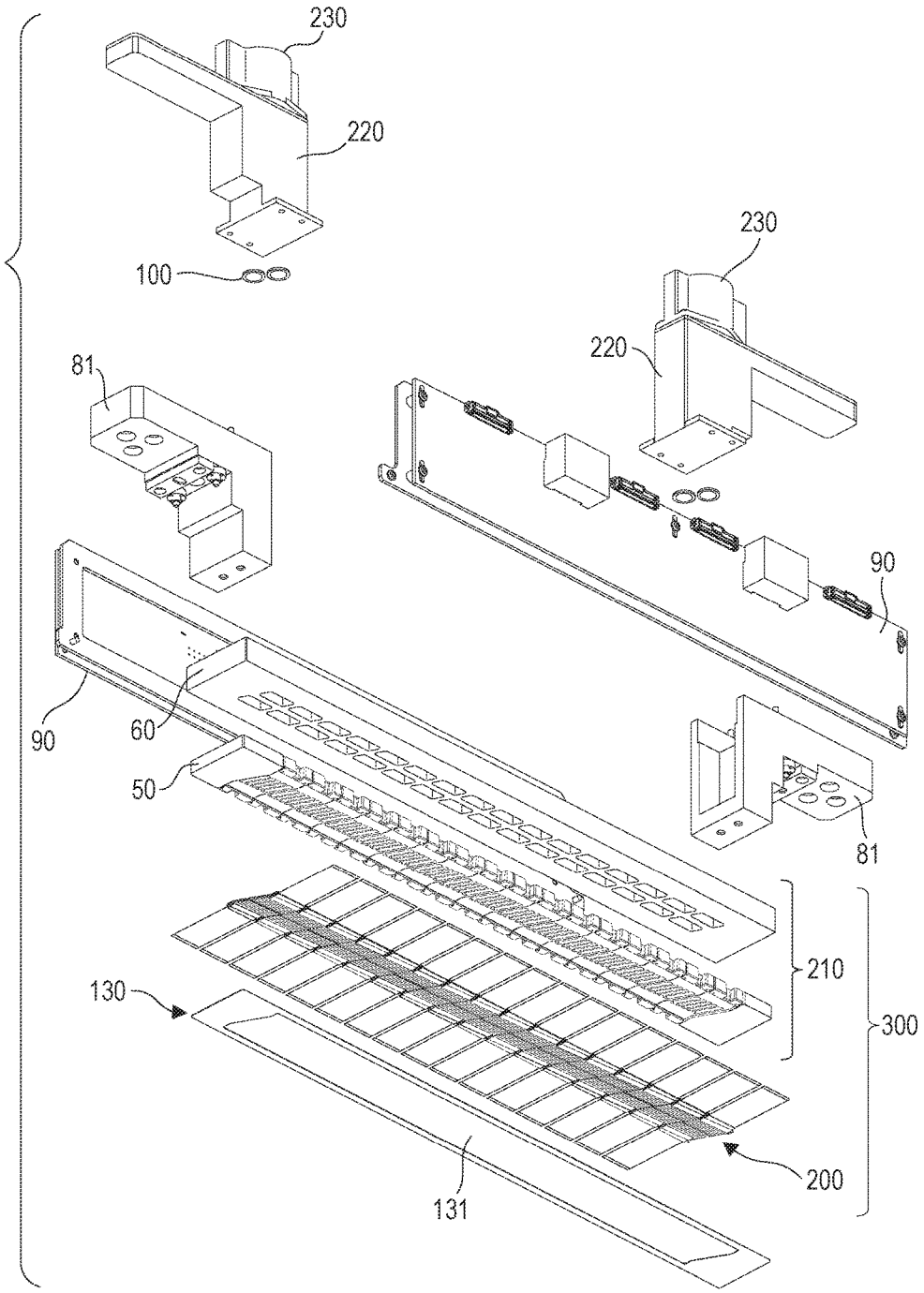
FIG. 20 is an exploded perspective view of the liquid discharging head shown in FIGS. 19A and 19B.

FIG. 20 is an exploded perspective view of one liquid discharging head 3. The roles of the components and the units that constitute each liquid discharging head 3 and the flow of liquid in each liquid discharging head 3 are basically the same as those according to the first exemplary embodiment. However, the function of ensuring the rigidity of each liquid discharging head 3 differs. In the first exemplary embodiment, the rigidity of the structure including the liquid discharging head is primarily ensured by the liquid discharging unit supporting portion 81, whereas in the second exemplary embodiment, the rigidity of each liquid discharging head 3 is ensured by a second channel member 60 of a liquid discharging unit 300. Liquid discharging unit supporting portions 81 according to the exemplary embodiment are interposed between a pair of electrical wiring boards 90, and are connected to respective end portions of the second channel member 60 of the liquid discharging unit 300. The liquid discharging unit 300 is mechanically connected to a carriage (not shown) of the recording device 1000, and positions the liquid discharging head 3. Liquid supplying units 220 of negative pressure controlling units 230 are connected to the respective liquid discharging unit supporting portions 81. Filters (not shown) are built in the two liquid supplying units 220. The two negative pressure controlling units 230 are individually set such that the interiors of ink channels are controlled to different pressures (negative pressures). As shown in FIG. 20, the negative pressure controlling unit 230 at a high pressure side is set at one end portion of each liquid discharging head 3, and the negative pressure controlling unit 230 at a low pressure side is set at the other end portion of each liquid discharging head 3, and ink flow in common supply channels 211 and ink flow in common recovery channels 212 extending in the longitudinal direction of the liquid discharging heads 3 are opposite each other. Therefore, heat exchange between the common supply channels 211 and the common recovery channels 212 is accelerated, so that the internal temperature difference between the common supply channels 211 and the common recovery channels 212 becomes small. Consequently, the temperature difference between the plurality of recording element boards 10 that are provided along the common supply channels 211 and the common recovery channels 212 is small, as a result of which recording unevenness caused by the temperature difference is unlikely to occur.

Next, a channel member 210 of the liquid discharging unit 300 is described in detail. As shown in FIG. 20, the channel member 210 is a multilayer body including a first channel member 50 and the second channel member 60, and distributes ink supplied from the liquid suppling units 220 to corresponding discharge modules 200. The channel member 210 also functions as a channel member for returning ink that circulates from the discharge modules 200 to the liquid supplying units 220. The second channel member 60 of the channel member 210 is a channel member having the common supply channels 211 and the common recovery channels 212 therein, and primarily has the role of ensuring the rigidity of the liquid discharging head 3. Therefore, the second channel member 60 is desirably made of a material having high mechanical strength and sufficiently corrosion resistant to ink. More specifically, the second channel member 60 is desirably made of, for example, stainless steel (SUS), titanium, or alumina.

Figure 21A:
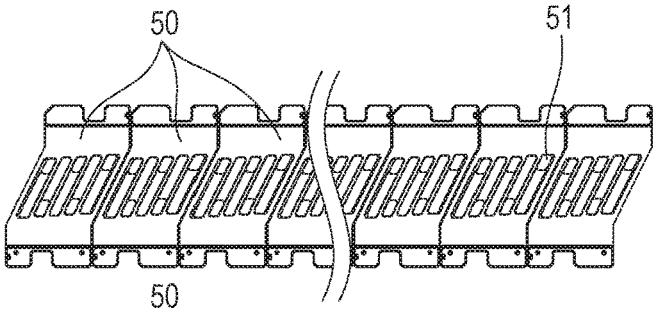
FIGS. 21A and 21B illustrate a first channel member and FIGS. 21C to 21E illustrate a second channel member of the liquid discharging head shown in FIGS. 19A and 19B.
Figure 21B:
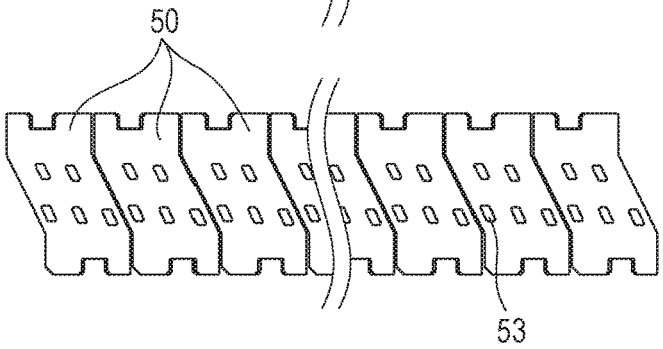
Figure 21C:
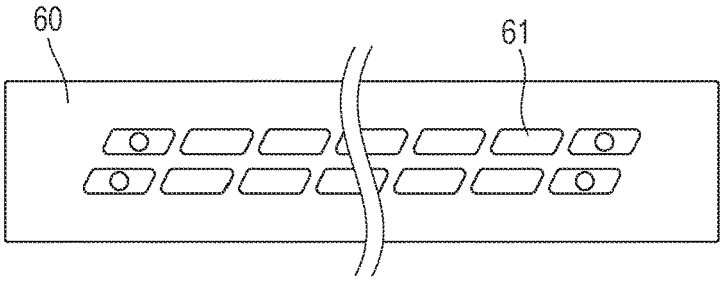
Figure 21D:
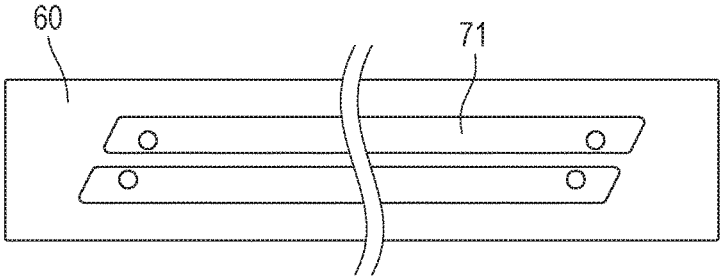
Figure 21E:
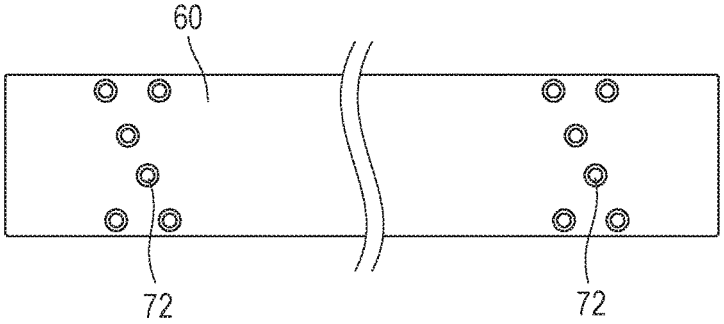

FIG. 21A illustrates a surface of the first channel member 50 on which the discharge modules 200 are mounted, and FIG. 21B illustrates a surface of the first channel member 50 that contacts the second channel member 60, which is a back surface of the first channel member 50. FIG. 21C illustrates a surface of the second channel member 60 that contacts the first channel member 50. FIG. 21D illustrates a section of a central portion of the second channel member 60 in a thickness direction. FIG. 21E illustrates a surface of the second channel member 60 that contacts the liquid supplying units 220. Unlike in the first exemplary embodiment, the first channel member 50 according to the second exemplary embodiment is one in which a plurality of members corresponding to the discharge modules 200 are arranged side by side. The first channel member 50 having such a divided structure allows the discharge modules 200 to be easily arranged in accordance with the overall length of the corresponding liquid discharging head 3, and is particularly suitable for a relatively long liquid discharging head 3 that is used with a large recording medium having, for example, a B2 size or greater.

Communicating ports 51 in the first channel member 50 shown in FIG. 21A are connected to the discharge modules 200 so as to allow circulation of a liquid. Individual communicating ports 53 of the first channel member 50 shown in FIG. 21B communicate with communicating ports 61 of the second channel member 60 so as to allow circulation of a liquid. The functions of the channels and communicating ports of the second channel member 60 are the same as those of the portions of the liquid discharging head 3 according to the first exemplary embodiment, each portion corresponding to ink of one color. Two common channel grooves 71 of the second channel member 60 constitute the common supply channel 211 and the common recovery channel 212 shown in FIGS. 22A and 22B. Ink flows from one end to the other end of each common channel groove 71 along the longitudinal direction of the corresponding liquid discharging head 3. In the second exemplary embodiment, unlike in the first exemplary embodiment, the direction of flow of ink in the common supply channel 211 and the direction of flow of ink in the common recovery channel 212 are opposite each other.

Figure 22A:
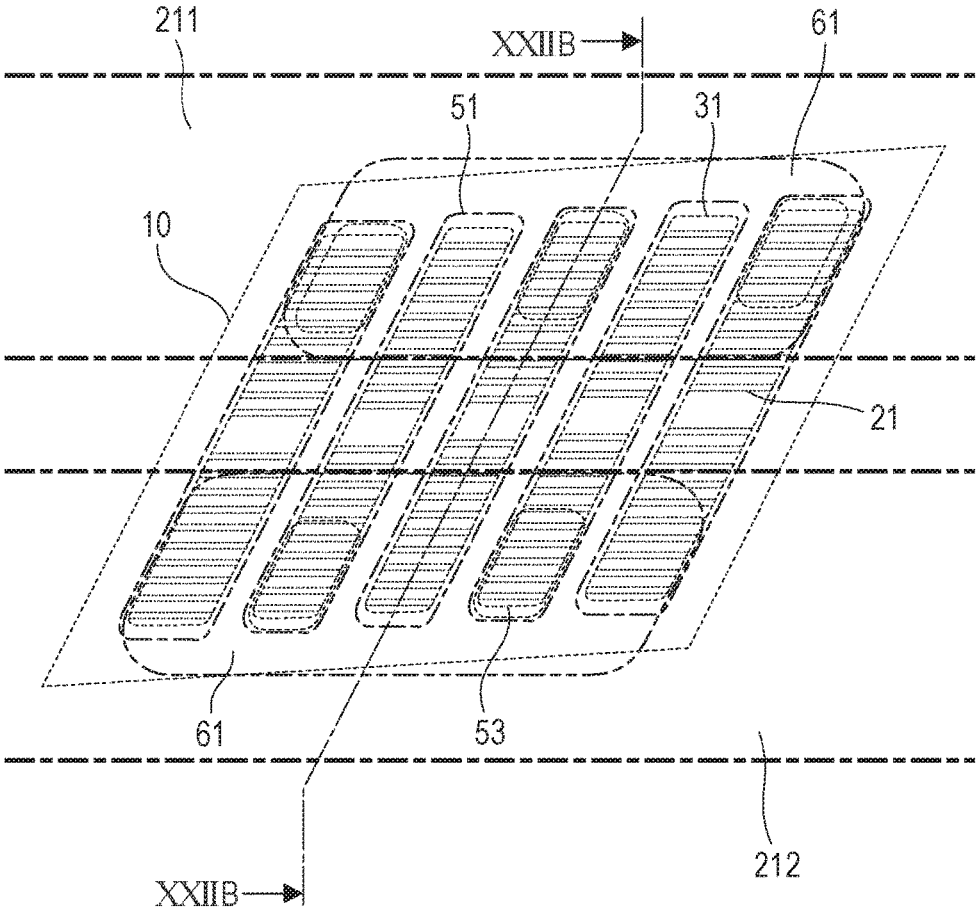
FIGS. 22A and 22B are respectively a perspective view and a sectional view showing the relationship between connections of channels of the liquid discharging head shown in FIGS. 19A and 19B.

FIG. 22A is a perspective view showing the relationship between connections in terms of ink between one recording element board 10 and the channel member 210. As shown in FIG. 22A, the common supply channel 211 and the common recovery channel 212 extending in the longitudinal direction of the liquid discharging head 3 are provided in the channel member 210. The communicating ports 61 of the second channel member 60 are aligned with and connected to the individual communicating port 53 of the first channel member 50. A liquid supply path that communicates with the communicating ports 51 of the first channel member 50 via the common supply channel 211 from communicating ports 72 of the second channel member 60 is formed. Similarly, a liquid supply path that communicates with the communicating ports 51 of the first channel member 50 via the common recovery channel 212 from the communicating ports 72 of the second channel member 60 is also formed.

Figure 22B:
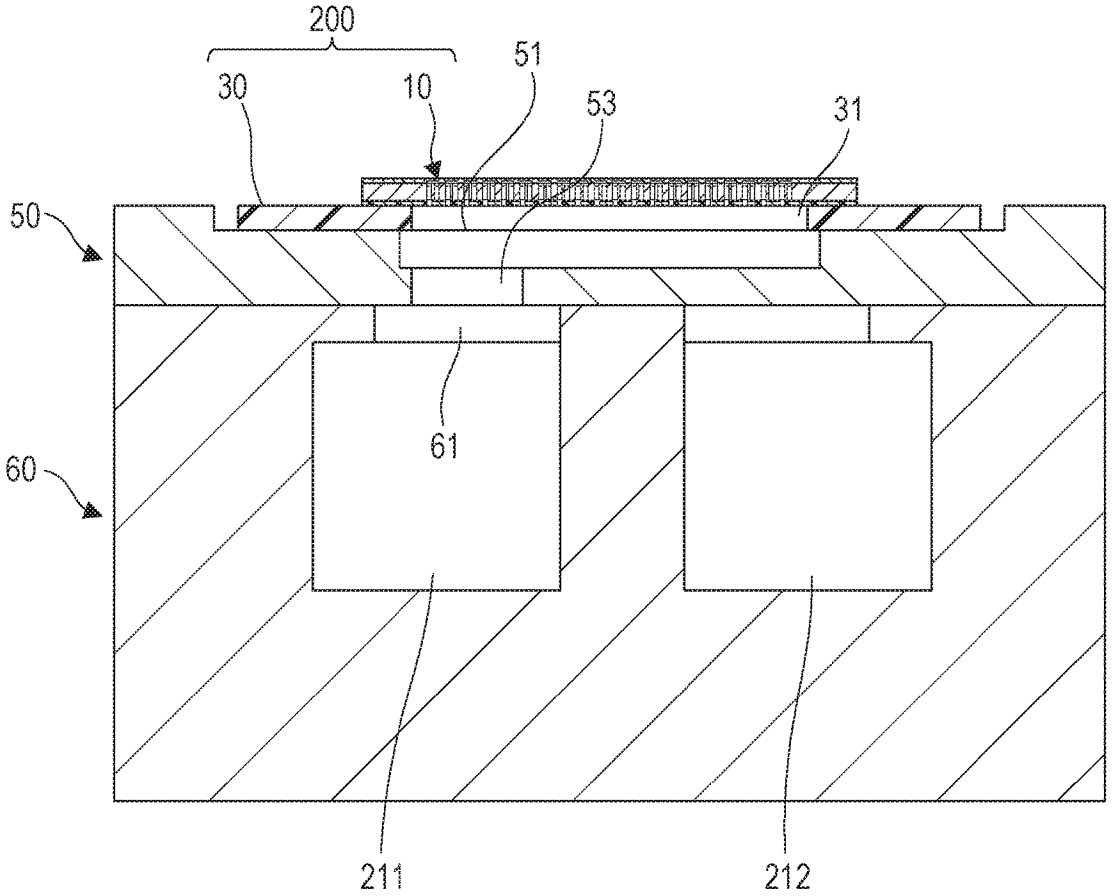

FIG. 22B is a sectional view taken along line XXIIB-XXIIB in FIG. 22A. As shown in FIG. 22B, the common supply channel is connected to the discharge modules 200 via the communicating ports 61, the individual communicating ports 53, and the communicating ports 51. Although not shown in FIG. 22B, that the individual recovery channels are connected to the discharge modules 200 by a similar path in a different section is apparent if FIG. 22A is referred to. As in the first embodiment, channels that communicate with the discharge ports are formed in the discharge modules 200 and the corresponding recording element board 10. Part or all of the supplied ink can passes through the discharge ports 13 (that is, the pressure chambers 23) that are not performing a discharge operation), and circulate. In addition, as in the first exemplary embodiment, the common supply channel 211 is connected to the negative pressure controlling unit 230 (high pressure side), and the common recovery channel 212 is connected to the negative pressure controlling unit 230 (low pressure side) via the liquid supplying units 220. Therefore, a difference between set pressures of the two negative pressure controlling units 230 (pressure difference between the two negative pressure controlling units 230) causes a flow to be generated from the common supply channel 211 to the common recovery channel 212 via the discharge ports 13 (that is, the pressure chambers 23) of the corresponding recording element board 10.

Discharge Modules

Figure 23A:
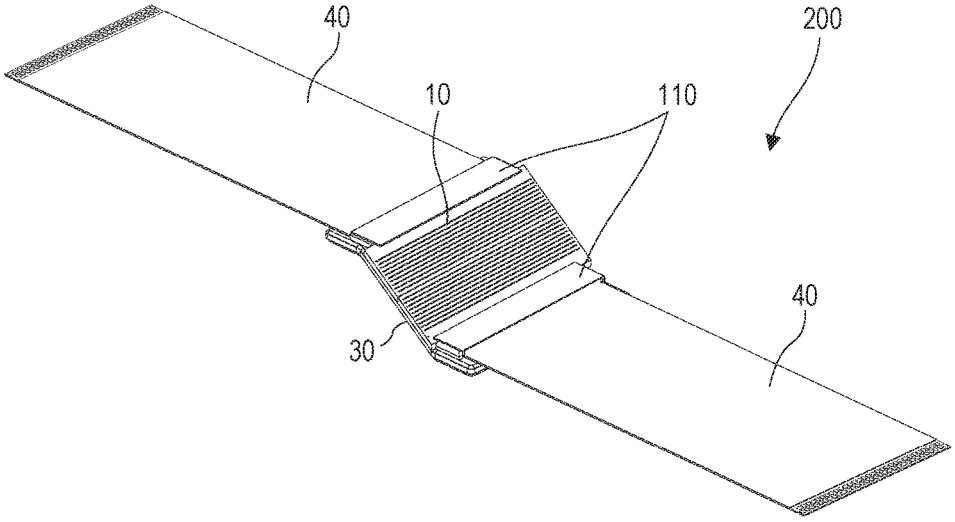
FIGS. 23A and 23B are respectively a perspective view and an exploded perspective view of a discharge module of the liquid discharging head shown in FIGS. 19A and 19B.
Figure 23B:
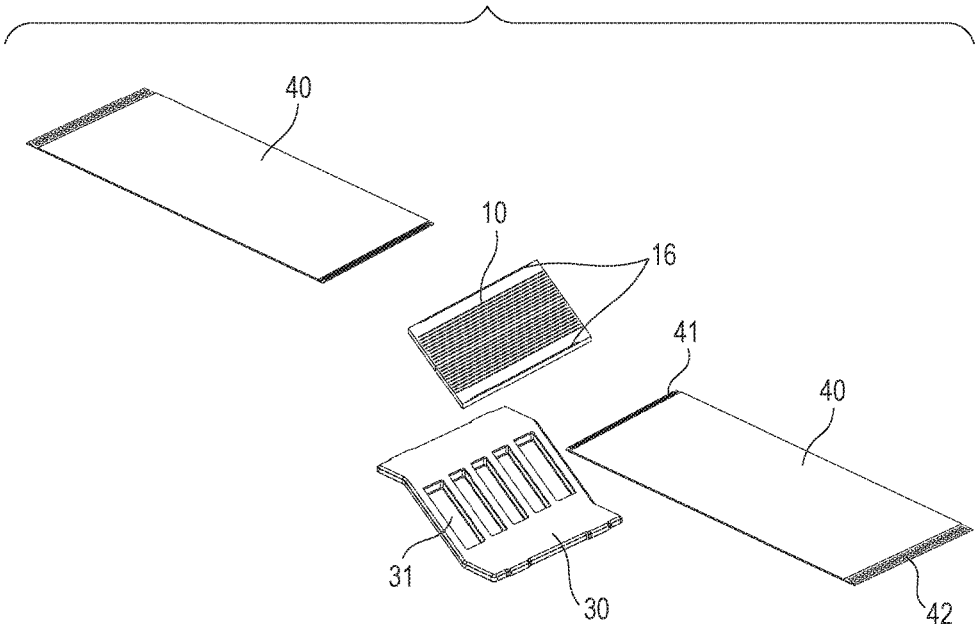

FIG. 23A is a perspective view of one discharge module 200, and FIG. 23B is an exploded view thereof. A difference from the first embodiment is that a plurality of rows of terminals 16 along a discharge port row direction are formed on respective end portions of the recording element board 10 in a direction orthogonal to the discharge port row direction. Two flexible printed circuit boards 40 that are electrically connected to these terminals 16 are disposed for one recording element board 10. This is because the number of discharge port rows of the recording element board 10 is 20, and is much larger than the number of discharge port rows (eight discharge port rows) according to the first exemplary embodiment. That is, the purpose is to reduce a delay in signal transmission and a reduction in voltage caused by wiring portions that are provided at the recording element board 10 by causing a maximum distance from the terminals 16 to the recording elements 15 that are provided in correspondence with the discharge ports to be small. Liquid communicating ports 31 of a supporting member 30 open on both sides of all discharge port rows of the recording element board 10. The other structural features are the same as those according to the first embodiment.

Structure of Recording Element Board

Figure 24A:
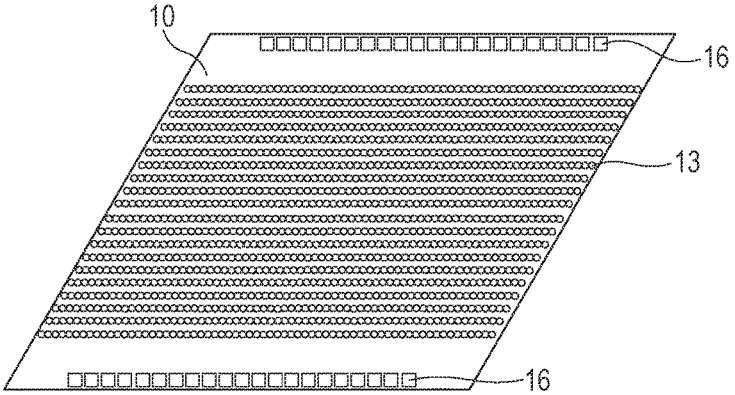
FIGS. 24A to 24C each illustrate a recording element board of the liquid discharging head shown in FIGS. 19A and 19B.
Figure 24B:
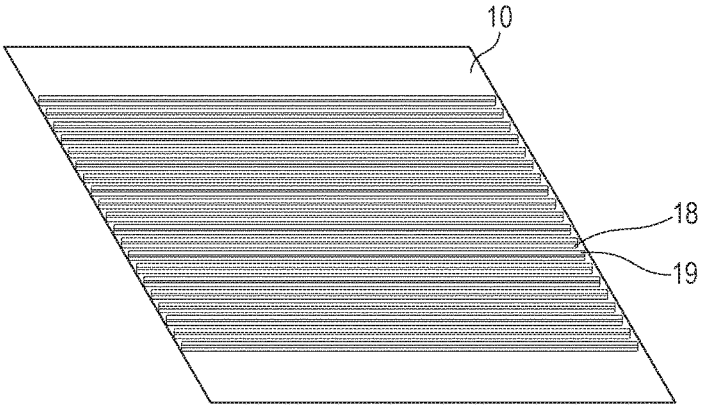
Figure 24C:
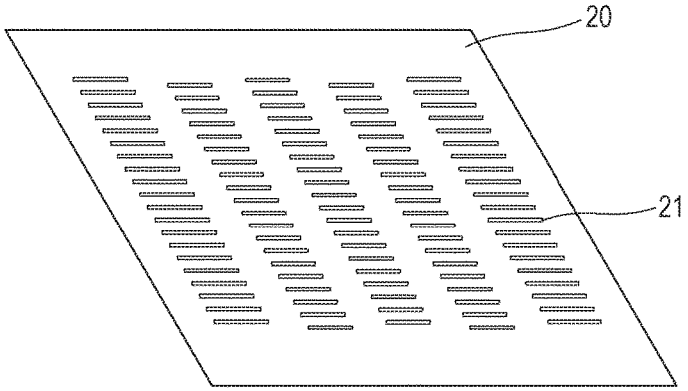

FIG. 24A is a perspective view of a surface of one recording element board 10 in which discharge ports 13 are disposed. FIG. 24C is a schematic view of a surface of the recording element board 10 opposite to the surface thereof shown in FIG. 24A. FIG. 24B is a schematic view of the recording element board 10 without a cover member 20 shown in FIG. 24C. As shown in FIG. 24B, liquid supply paths 18 and liquid recovery paths 19 extending along the discharge port row direction are alternately provided at the back surface of the recording element board 10. An essential difference from the recording element boards 10 according to the first embodiment shown in FIG. 11A is that the rows of terminals 16 extending in the discharge port row direction are formed on both end portions of the recording element board as mentioned above. In addition, the number of discharge port rows is much larger than that in the first exemplary embodiment. However, the other basic structural features, such as one set of liquid supply path 18 and liquid recovery path 19 being provided for each discharge port row and the cover member 20 having openings 21 that communicate with the liquid communicating ports 21 of the supporting member 30 are the same as those according to the first exemplary embodiment.

The present disclosure makes it possible to reduce the generation of satellite droplets and to perform proper liquid discharge.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-144669 filed Jul. 22, 2016, which is hereby incorporated by reference herein in its entirety.

What is claimed is:

1. A liquid discharging head comprising:

a discharge port that discharges a liquid;

a pressure chamber that communicates with the discharge port;

an energy generating element that is disposed in the pressure chamber;

a supply path that supplies a liquid to the pressure chamber; and a recovery path that recovers the liquid from the pressure chamber, wherein the discharge port is provided with a plurality of projections that project towards a central portion of the discharge port from an inner peripheral edge of the discharge port, wherein an interval between the projections at a location where the projections are closest to each other is 5 μm or less, and wherein the supply path and the recovery path are connected to the pressure chamber so as to allow a circulatory flow of a liquid flowing from the supply path to the recovery path via the pressure chamber to be generated.

2. The liquid discharging head according to claim 1, wherein the discharge port has a linearly symmetrical shape.

3. The liquid discharging head according to claim 2, wherein a symmetry axis of the linearly symmetrical shape of the discharge port is parallel to a direction of flow of a liquid that passes through the pressure chamber.

4. The liquid discharging head according to claim 1, wherein leading end portions of the plurality of projections oppose each other.

5. The liquid discharging head according to claim 1, wherein center lines of the plurality of projections are on a same line.

6. The liquid discharging head according to claim 1, wherein leading end portions of the plurality of projections do not oppose each other.

7. The liquid discharging head according to claim 1, wherein the projections extend parallel to a direction of flow of a liquid that passes through the pressure chamber.

8. The liquid discharging head according to claim 1, wherein each projection has a tapering shape in which a width of a base thereof that projects from the inner peripheral edge of the discharge port is larger than a width of a leading end portion thereof.

9. The liquid discharging head according to claim 1, wherein the energy generating element is disposed as a location opposing the discharge port, and a distance from the energy generating element to the discharge port is 12 μm or less.

10. The liquid discharging head according to claim 1, further comprising:

a substrate; and a discharge port forming member that is placed on the substrate, wherein the discharge port forming member has a liquid discharge path extending through the discharge port forming member, wherein the discharge port is an open end of the liquid discharge path that opens in a surface of the discharge port forming member that is opposite to a surface of the discharge port forming member on which the substrate is placed, and wherein the pressure chamber is disposed between the substrate and the discharge port forming member, and communicates with the liquid discharge path.

11. The liquid discharging head according to claim 10, wherein a thickness of the discharge port forming member is 6 μm or less.

12. The liquid discharging head according to claim 10, wherein a length of the liquid discharge path in a liquid discharge direction is 6 μm or less.

13. The liquid discharging head according to claim 10, wherein H which is a height of a channel in a thickness direction of the discharge port forming member and the substrate, P which is a length of the liquid discharge path in a liquid discharge direction, and W which is a length of the discharge port along a direction of flow of a liquid that passes through the pressure chamber satisfy a relationship: $H^{-0.34} \times P^{-0.66} \times W > 1.7$, with the channel being disposed on an upstream side of the pressure chamber in the direction of the flow of the liquid that passes through the pressure chamber.

14. The liquid discharging head according to claim 1, wherein a liquid having a viscosity that is 15 cP or less is discharged.

15. The liquid discharging head comprising:

a discharge port that discharges a liquid;

a pressure chamber that communicates with the discharge port;

an energy generating element that is disposed in the pressure chamber;

a supply path that supplies a liquid to the pressure chamber; and a recovery path that recovers the liquid from the pressure chamber, wherein part of the discharge port is narrowed, and is shortest diameter of the part of the discharge port that has been narrowed is 5 μm or less, and wherein the supply path and the recovery path are connected to the pressure chamber so as to allow a circulatory flow of a liquid flowing from the supply path to the recovery path via the pressure chamber to be generated.

16. The liquid discharging head according to claim 15, wherein the shortest diameter extends through a center of the discharge port.

17. A liquid discharging device comprising:

a liquid discharging head including:

a discharge port that discharges a liquid;

a pressure chamber that communicates with the discharge port; and an energy generating element that is disposed in the pressure chamber, wherein the discharge port is provided with a plurality of projections that project towards a central portion of the discharge port from an inner peripheral edge of the discharge port, and wherein an interval between the projections at a location where the projections are closest to each other is 5 μm or less;

a supply path that supplies a liquid to the pressure chamber; and a recovery path that recovers the liquid from the pressure chamber, wherein the supply path and the recovery path are connected to the pressure chamber so as to allow a circulatory flow of a liquid flowing from the supply path to the recovery path via the pressure chamber to be generated; and a liquid supplying system that is connected to the supply path and the recovery path, and includes a tank which stores a liquid and a pump which causes the liquid to flow.

18. The liquid discharging device according to claim 17, wherein the liquid discharging head and the liquid supplying system form a circulation channel of the liquid that passes through the pressure chamber.

19. liquid discharging head comprising:

a discharge port that discharges a liquid;

a pressure chamber that communicates with the discharge port; and an energy generating element that is disposed in the pressure chamber, wherein the discharge port is provided with a plurality of projections that project towards a central portion of the discharge port from an inner peripheral edge of the discharge port, wherein an interval between the projections at a location where the projections are closest to each other is 5 μm or less, and wherein leading end portions of the plurality of projections do not oppose each other.

20. liquid discharging head comprising:

a discharge port that discharges a liquid;

a pressure chamber that communicates with the discharge port; and an energy generating element that is disposed in the pressure chamber, wherein the discharge port is provided with a plurality of projections that project towards a central portion of the discharge port from an inner peripheral edge of the discharge port, wherein an interval between the projections at a location where the projections are closest to each other is 5 μm or less, and wherein the energy generating element is disposed as a location opposing the discharge port, and a distance from the energy generating element to the discharge port is 12 μm or less.

21. liquid discharging head comprising:

a discharge port that discharges a liquid;

a pressure chamber that communicates with the discharge port;

an energy generating element that is disposed in the pressure chamber;

a supply path that supplies a liquid to the pressure chamber; and a recovery path that recovers the liquid from the pressure chamber, wherein the discharge port is provided with a plurality of projections that project towards a central portion of the discharge port from an inner peripheral edge of the discharge port, wherein an interval between the projections at a location where the projections are closest to each other is 5 μm or less, and wherein a liquid having a viscosity that is 15 cP or less is discharged.

22. liquid discharging head comprising:

a discharge port that discharges a liquid;

a pressure chamber that communicates with the discharge port;

an energy generating element that is disposed in the pressure chamber;

a supply path that supplies a liquid to the pressure chamber;

a recovery path that recovers the liquid from the pressure chamber;

a substrate; and a discharge port forming member that is placed on the substrate, wherein the discharge port is provided with a plurality of projections that project towards a central portion of the discharge port from an inner peripheral edge of the discharge port, wherein an interval between the projections at a location where the projections are closest to each other is 5 μm or less, and wherein a thickness of the discharge port forming member is 6 μm or less.

* * * * *